US010525754B2

(12) United States Patent
Tominaga et al.

(10) Patent No.: US 10,525,754 B2
(45) Date of Patent: Jan. 7, 2020

(54) INK JET RECORDING METHOD AND INK JET RECORDING APPARATUS

(71) Applicant: CANON KABUSHIKI KAISHA, Tokyo (JP)

(72) Inventors: Akiko Tominaga, Kawasaki (JP); Tsuyoshi Kanke, Yokohama (JP); Satoshi Takebayashi, Tokyo (JP); Junichi Sakai, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/023,283

(22) Filed: Jun. 29, 2018

(65) Prior Publication Data

US 2019/0009603 A1 Jan. 10, 2019

(30) Foreign Application Priority Data

Jul. 4, 2017 (JP) ..... 2017-131064
Jun. 11, 2018 (JP) ..... 2018-111477

(51) Int. Cl.

| | |
|---|---|
| ***B41J 2/01*** | (2006.01) |
| ***B41M 5/00*** | (2006.01) |
| ***B41J 29/17*** | (2006.01) |
| *B41M 5/025* | (2006.01) |
| *B41M 7/00* | (2006.01) |

(52) U.S. Cl.

CPC ..... *B41M 5/0017* (2013.01); *B41J 2/01* (2013.01); *B41J 29/17* (2013.01); *B41J 2002/012* (2013.01); *B41M 5/0256* (2013.01); *B41M 7/00* (2013.01); *B41M 7/0018* (2013.01)

(58) Field of Classification Search

CPC ..... B41J 2/01; B41J 29/17; B41J 2002/012; B41M 5/0017; B41M 5/0256

See application file for complete search history.

(56) References Cited

U.S. PATENT DOCUMENTS

| | | | | |
|---|---|---|---|---|
| 6,460,988 | B1 | 10/2002 | Mafune et al. | |
| 6,474,778 | B1 * | 11/2002 | Koitabashi | B41J 2/2107 347/100 |
| 6,702,882 | B2 | 3/2004 | Yakushigawa et al. | |
| 6,706,100 | B2 | 3/2004 | Mafune et al. | |
| 6,706,104 | B2 | 3/2004 | Takuhara et al. | |
| 6,843,839 | B2 | 1/2005 | Kanke et al. | |
| 6,866,380 | B2 | 3/2005 | Yakushigawa et al. | |
| 7,008,977 | B2 | 3/2006 | Sakai et al. | |
| 7,195,664 | B2 | 3/2007 | Mafune et al. | |

(Continued)

FOREIGN PATENT DOCUMENTS

| | | |
|---|---|---|
| JP | 2009-226907 A | 10/2009 |
| JP | 2013-180408 A | 9/2013 |

*Primary Examiner* — Lamson D Nguyen

(74) *Attorney, Agent, or Firm* — Venable LLP

(57) ABSTRACT

Provided is an ink jet recording method for recording an image on a recording medium by making use of an aqueous reaction liquid containing a reactant and first and second inks which are aqueous inks containing a coloring material. This method has a step of applying the reaction liquid to a first recording medium, a step of applying the first and second inks, in order of mention, to the first recording medium to form a first image and a step of bringing a porous layer of a liquid absorption member into contact with the first image and thereby absorbing a liquid component therefrom. The second image has brightness higher than that of the first ink.

16 Claims, 2 Drawing Sheets

(56) References Cited

U.S. PATENT DOCUMENTS

| | | | | |
|---|---|---|---|---|
| 7,866,786 | B2 * | 1/2011 | Matsuzawa | B41J 2/2103<br>347/19 |
| 8,393,726 | B2 | 3/2013 | Moribe et al. | |
| 9,783,694 | B2 | 10/2017 | Tominaga et al. | |
| 2019/0009579 | A1 * | 1/2019 | Inoue | B41J 2/0057 |
| 2019/0009601 | A1 * | 1/2019 | Ohnishi | B41J 2/01 |
| 2019/0100672 | A1 * | 4/2019 | Mizutani | B41J 2/04563 |
| 2019/0126654 | A1 * | 5/2019 | Nishitani | B41M 3/001 |

* cited by examiner

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

As an ink to be used in an ink jet recording method, a water-based ink has been used popularly. In order to immediately remove the liquid component in an ink, there is a method of drying a recording medium with warm air, infrared ray, or the like and then recording an image thereon. There is also a method of forming, as an intermediate image, a first image on a transfer body with a water-based ink, removing the liquid component contained in the first image by thermal energy or the like, and then transferring the resulting first image to a recording medium to record an image. An ink jet recording method including a step of applying a reaction liquid containing a reactant and then a kind of an ink to a recording medium to form a first image and a step of bringing a porous body into contact with the first image to remove a liquid component from the first image is under investigation (refer to Japanese Patent Application Laid-Open No. 2009-226907). Also an ink jet recording method including a step of applying a reaction liquid containing a reactant and then a plurality of kinds of inks to a recording medium to form a first image is under investigation (refer to Japanese Patent Application Laid-Open No. 2013-180408).

SUMMARY OF THE INVENTION

As a result of investigation, the present inventors have found that when many images are recorded using an ink jet recording method similar to that described in Japanese Patent Application Laid-Open No. 2009-226907 except for the use of two kinds of water-based inks, there is a room for improvement in the contamination of an image recorded with a plurality of inks. In the ink jet recording method described in Japanese Patent Application Laid-Open No. 2013-180408, removal of a liquid component from the first image by bringing a porous body into contact therewith is not disclosed.

An object of the invention is therefore to provide an ink jet recording method capable of suppressing contamination of images even after recording of many images. Another object of the invention is to provide an ink jet recording apparatus using the above-described ink jet recording method.

The above-described objects can be fulfilled by the following invention. Described specifically, the invention relates to an ink jet recording method for recording images on a recording medium by making use of an aqueous reaction liquid containing a reactant and a first ink and a second ink, each being a water-based ink containing a coloring material. This method includes a reaction liquid applying step for applying the reaction liquid to a first recording medium, an image formation step for applying the first ink and the second ink in order of mention to the first recording medium so as to overlap at least partially with a region to which the reaction liquid has been applied to form a first image and a liquid absorption step for bringing a porous layer possessed by a liquid absorption member into contact with the first image to absorb a liquid component from the first image. In this method, brightness of the second ink is higher than that of the first ink.

The invention also relates to an ink jet recording apparatus having a unit for applying a reaction liquid to a first recording medium and then applying a first ink and a second ink in order of mention and a unit for bringing a porous layer possessed by a liquid absorption member into contact with a first image formed with the reaction liquid, the first ink, and the second ink. In this apparatus, the reaction liquid is an aqueous reaction liquid containing a reactant, the first ink and the second ink are each a water-based ink containing a coloring material, and the second ink has brightness higher than that of the first ink.

The invention can provide an ink jet recording method and an ink jet recording apparatus capable of suppressing contamination of images even after recording of many images.

Further features of the present invention will become apparent from the following description of exemplary embodiments with reference to the attached drawings.

DESCRIPTION OF THE EMBODIMENTS

Figure 1:
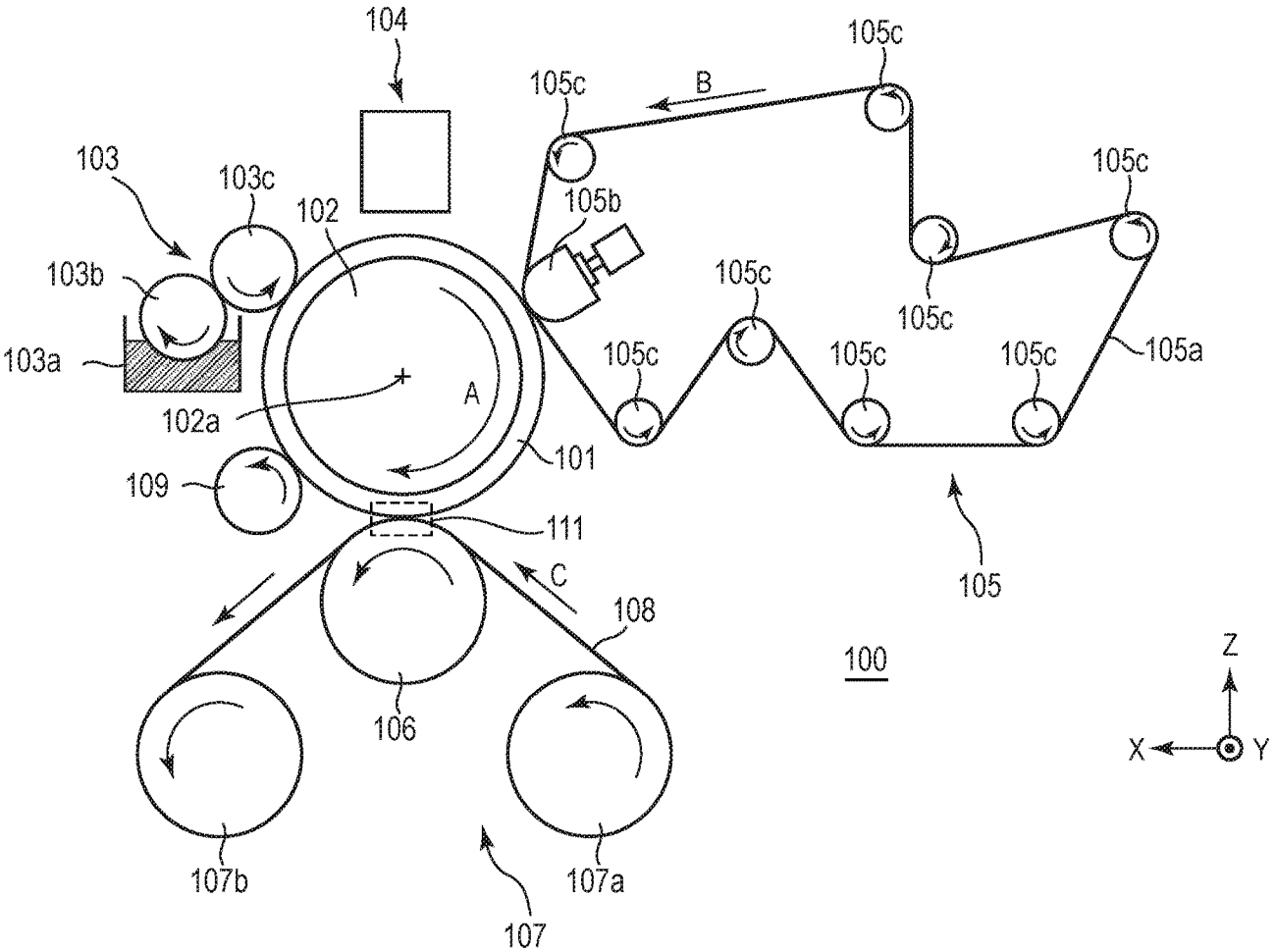
FIG. 1 is a schematic view showing one example of a transfer type ink jet recording apparatus to be used in the ink jet recording method of the invention.

Preferred embodiments of the present invention will now be described in detail in accordance with the accompanying drawings.

The embodiments of the invention will hereinafter be described in detail. In the invention, the terms "water-based ink", "first ink" and "second ink" may hereinafter be called "ink". The term "aqueous reaction liquid" may be called "reaction liquid". Values of various physical properties are at 25° C. unless otherwise particularly specified. The terms "(meth)acrylic acid" and "(meth)acrylate" mean "acrylic acid and methacrylic acid" and "acrylate and methacrylate", respectively. "C.I." is an abbreviation of Color Index.

The ink jet recording method of the invention makes use of an aqueous reaction liquid and a water-based ink containing a first ink and a second ink. When a first ink and a second ink each containing a coloring material are applied to a first recording medium so as to overlap at least partially with a region to which a reaction liquid containing a reactant has been applied, the ink comes into contact with the reaction liquid and the reactant causes aggregation of a component (such as the coloring material) in the ink to increase the viscosity of the ink. The increase in the viscosity of the ink leads to an increase in the viscosity of a first image formed with the reaction liquid and ink. This facilitates close adhesion of the first image to the first recording medium. Further, compared with an image formed only with the ink, the first image formed with the reaction liquid and ink contains a larger amount of liquid components so that even when a porous layer possessed by a liquid absorption member comes into contact with the first image, it is likely to come into contact with the liquid component rather than the coloring material in the first image. This hinders adhesion of the coloring material to the porous layer.

Under conditions where the liquid absorption member is used in repetition for recording of many images, however, the coloring material adheres to the surface of the porous layer. When the porous layer to which the coloring layer has adhered comes into contact with first images formed subsequently, the coloring material adheres also to the first images, causing contamination of images.

It has been found that particularly in the case where two water-based inks different in brightness are used and application of the ink having higher brightness to the first recording medium is followed by application of the other ink having lower brightness, it is difficult to protect the resulting image from being contaminated. The present inventors investigated the reason why it was difficult to prevent image contamination. Use of a coloring material having higher brightness provides an ink having higher brightness, while use of a coloring material having lower brightness provides an ink having lower brightness. When an ink having higher brightness and an ink having lower brightness are applied to a first recording medium in order of mention, a coloring material in the ink having lower brightness present on the surface side of a first image is likely to adhere to the porous layer. Further, recording of an image then inevitably brings the porous layer to which the coloring material with lower brightness has adhered into contact with a first image so that the coloring material with lower brightness adheres to a subsequent first image. Adhesion of the coloring material with lower brightness to the first image causes contamination of images because the coloring material with lower brightness is conspicuous.

Considering that the presence of an ink having higher brightness on the surface side of the first image is necessary for suppressing an image from being contaminated even after repeated use of a liquid absorption member, the present inventors have completed the invention. In the ink jet recording method of the invention, application of a first ink having low brightness to a first recording medium is followed by application of a second ink having higher brightness. Even if a higher-brightness coloring material which has adhered to the porous layer then adheres to a subsequent first image, it is less conspicuous so that contamination of images can be suppressed.

If a liquid absorption member such as porous body is not used for removal of a liquid component from a first image as in Japanese Patent Application Laid-Open No. 2013-180408, it is impossible to recognize a problem, that is, contamination of images attributable to the use of the liquid absorption member.

The ink jet recording method of the invention, whether it is either one of the following method (1) or (2), can suppress contamination of recorded images.

(1) A method of transferring a first image, which has been formed by applying an ink to a first recording medium, to a recording medium to record an image.

(2) A method of applying an ink directly to a recording medium to record an image.

In the case of (1), the first recording medium is a transfer body and this ink jet recording method preferably has, after a liquid absorption step, a transfer step, that is, a step of transferring the first image on the transfer body to the recording medium. Ink jet recording apparatuses usable in the methods (1) and (2), respectively, will next be described. For the convenience sake, an ink jet recording apparatus usable in the method (1) will be called "transfer type ink jet recording apparatus", while that usable in the method (2) will be called "direct recording type ink jet recording apparatus".

<Transfer Type Ink Jet Recording Apparatus>

FIG. 1 is a schematic view showing one example of a transfer type ink jet recording apparatus to be used in the ink jet recording method of the invention. The first recording medium when the transfer type ink jet recording apparatus is used is a transfer body.

Transfer type ink jet recording apparatus 100 is a sheet feed type ink jet recording apparatus which manufactures a recorded product by transferring a first image to a sheet-shaped recording medium 108 via a transfer body 101. Directions X, Y and Z mean a width direction (entire length direction), depth direction and height direction, respectively, of the transfer type ink jet recording apparatus 100. The recording medium is conveyed in the direction X.

The transfer type ink jet recording apparatus 100 has, as shown in FIG. 1, the transfer body 101 supported by a support member 102 and a reaction liquid applying unit 103 for applying a reaction liquid to the transfer body 101. It further has an ink applying unit 104 equipped with a recording head for applying an ink to the transfer body 101 to which the reaction liquid has been applied and forming a first image, a liquid absorption unit 105 for absorbing a liquid component from the first image and a pressing member 106 for transferring the first image to the recording medium 108. The recording head ejects an ink through an ink jet system. The transfer type ink jet recording apparatus 100 may have a transfer body cleaning member 109 for cleaning the surface of the transfer body 101 after transfer. The transfer body 101, the reaction liquid applying unit 103, the recording head possessed by the ink applying unit 104, the liquid absorption unit 105 and the transfer body cleaning member 109 each have, in the direction Y, a length corresponding to the recording medium 108 used.

The transfer body 101 rotates in the direction of the arrow A with a rotation axis 102*a* of the support member 102 as a center. The transfer body 101 rotates with the rotation of this support member 102. A reaction liquid is applied from the reaction liquid applying unit 103 to this rotating transfer body 101. Then, an ink is applied from the ink applying unit 104 to a region of the transfer body 101 to which the reaction liquid has been applied. In such a manner, a first image is formed on the transfer body 101. By the rotation of the transfer body 101, the first image formed on the transfer body 101 moves to a position where it comes into contact with a liquid absorption member 105*a* possessed by the liquid absorption unit 105.

The liquid absorption member 105*a* rotates in synchronization with the rotation of the transfer body 101. The first image formed on the transfer body 101 comes into contact with the rotating liquid absorption member 105*a*. During this contact state, the liquid absorption member 105*a* absorbs a liquid component from the first image. From the standpoint of efficient absorption of the liquid component, the liquid absorption member 105*a* is preferably pressed by the transfer body 101 at a certain pressing force.

Since the first image is formed with the reaction liquid, the first ink and the second ink, the term "absorption of a liquid component in the ink" means absorption of a liquid component in the reaction liquid, the first ink and the second ink. By the absorption of the liquid component, the liquid component is removed from the first image so that absorption of the liquid component is, in other words, concentration of the ink. Concentration of the ink decreases the liquid component in the ink and thereby increases a ratio of a solid component such as coloring material and resin in the ink to the liquid component.

The first image in which the ink is concentrated as a result of absorption of the liquid component moves to a region where it comes into contact with the recording medium 108 by the rotation of the transfer body 101. The first image and the recording medium 108 are brought into contact with each other by being pressed from the side of the pressing member 106 while being sandwiched between the transfer body 101 and the pressing member 106. When a roller type transfer body 101 and a columnar pressing member 106 are used, the first image and the recording medium 108 come into linear contact along the direction Y. At this time, when the transfer body 101 is comprised of a material having elasticity, the transfer body 101 is dented by pressing force and the first image and the recording medium 108 come into surface contact. The contact point or contact surface between the first image and the recording medium 108 is regarded as a "region" and a portion containing this region is designated as a "transfer unit 111". During contact of the liquid component-absorbed first image with the recording medium 108, the pressing member 106 presses the transfer body 101 to transfer the first image to the recording medium 108. A second image transferred to the recording medium 108 is a reversed image of the first image formed on the transfer body 101. The term "second image" as used herein means a final image and the term "first image" means an image other than the final image. Formation of the final image may be followed by thermal fixing or lamination.

When the reaction liquid is applied to the transfer body with a roller or the like, the reaction liquid is applied all over the transfer body. In a region to which the reaction liquid has been applied but no ink has been applied, the reaction liquid exists without reacting with the ink. This means that the liquid absorption member 105*a* absorbs not only the liquid component from the first image, but coming into contact with the reaction liquid which has not reacted with the ink, it absorbs also the liquid component of the reaction liquid. During absorption of the liquid component from the first image, the liquid component is removed also from the reaction liquid which has been applied to the transfer body but has not reacted with the ink. The liquid component contained in the ink or the reaction liquid has fluidity and almost a constant volume without having a particular shape. More specifically, an aqueous medium or the like which is a component contained in the ink or reaction liquid is a liquid component.

Next, main units constituting the transfer type ink jet recording apparatus such as [1] transfer body, [2] support member, [3] reaction liquid applying unit, [4] ink applying unit, [5] liquid absorption unit, [6] pressing member for transfer, [7] recording medium and [8] recording medium conveying unit will be described.

[1] Transfer Body 101

The transfer body 101 has a surface layer as a first image formation surface. Examples of a material constituting the surface layer include resins and ceramics. From the standpoint of durability, materials having a high compressive elastic modulus are preferred. It may be subjected to surface treatment to have improved wettability with the reaction liquid, transferability and the like. The surface layer of it may have any shape.

The transfer body has preferably a compression layer having a function of absorbing pressure variation between the surface layer and the support member. The compression layer absorbs deformation of the surface layer of the transfer body and disperses local pressure variation if any so that the transfer body provided with the compression layer can maintain good transferability even during high-speed recording. Examples of a material constituting the compression layer include materials having elasticity such as rubber materials. Among them, rubber materials obtained by mixing a foaming agent, hollow fine particles and a filler such as salt together with a vulcanizing agent and a vulcanizing accelerator and formed as a porous body are preferred. When pressure variation occurs, a void portion is compressed with a volume change so that deformation of such materials in a direction other than a compressing direction is small and they can have improved transferability and durability. Examples of the rubber materials formed as a porous body include those having a continuous void structure having voids connected to each other and those having an independent void structure having voids independent of each other.

The transfer body preferably has an elastic layer between the surface layer and the compression layer. Examples of a material constituting the elastic layer include resin materials and ceramic materials. Among them, due to easy processability, a small change in elastic modulus due to temperature and excellent transferability, materials having elasticity such rubber materials are preferably used.

Layers constituting the transfer body (surface layer, elastic layer, compression layer) can be bonded to one another using an adhesive or double-sided tape. In order to suppress transverse elongation and keep resilience at the time of installing the transfer body in the apparatus, a reinforcing layer having a high compressive modulus may be provided. As the reinforcing layer, a woven fabric or the like can be used. The transfer body can be manufactured using, not to mention of the surface layer, the elastic layer and the compression layer in any combination.

The size of the transfer body can be selected freely depending on a recording rate or image size. Examples of the shape of the transfer body include sheet shape, roller shape, belt shape and endless web shape.

[2] Support Member 102

The transfer body 101 is supported by the support member 102. For the support of the transfer body, an adhesive or double-sided tape can be used. Alternatively, a fixing member comprised of a material such as metal, ceramic or resin is attached to the transfer body and with this fixing member, the transfer body may be fixed to the support member 102.

The support member 102 is required to have certain structural strength from the standpoint of conveyance accuracy and durability. Examples of a material constituting the support member include metal materials, ceramic materials and resin materials. Of these, metal materials such as aluminum are preferably used in view of rigidity enough to withstand the stress at the time of transfer, size accuracy and also reduction of the inertia during operation to improve the control responsivity.

[3] Reaction Liquid Applying Unit 103

The ink jet recording method of the invention has a reaction liquid applying step for applying the reaction liquid to the first recording medium prior to the image formation step. When the reaction liquid is brought into contact with an ink, the reactant in the liquid can aggregate an anionic group-containing component (resin, self-dispersible pigment, or the like) in the ink. After application of the first ink and the second ink, the reaction liquid may be applied further so as to overlap at least partially with a region to which the first ink and the second ink have been applied.

The transfer type ink jet recording apparatus has a reaction liquid applying unit 103 for applying the reaction liquid to the transfer body 101. In FIG. 1, shown as the reaction liquid applying unit 103 is a gravure offset roller having a reaction liquid storage unit 103*a* for storing therein the reaction liquid and reaction liquid applying members 103*b* and 103*c* for applying the reaction liquid in the reaction liquid storage unit 103*a* to the transfer body 101.

The reaction liquid applying unit is only required to be able to apply the reaction liquid to the transfer body and examples thereof include a gravure offset roller and an ink jet system recording head. Particularly, the reaction liquid is preferably applied to the transfer body with a roller. In application of the reaction liquid to the transfer body with a roller, the reaction liquid is applied all over the transfer body so that there is a region to which no ink has been applied but only the reaction liquid has been applied. When the porous layer comes into contact with not only the region to which the reaction liquid and the ink have been applied but also the region to which only the reaction liquid has been applied, the reactant in the reaction liquid is likely to adhere to the surface of the porous layer. The reactant which has adhered to the surface aggregates the component (such as coloring material) in the ink and the aggregated component in the ink adheres to the surface of the porous layer, which may hinder the porous layer from absorbing the liquid component from the first image. Then, the porous layer to which the aggregated component in the ink has adhered comes into contact with a subsequent first image and the component in the ink adheres to this first image. This may lead to a failure in sufficiently preventing the resulting images from being contaminated. Even in such a case, by applying a first ink with lower brightness to a first recording medium and then applying a second ink with higher brightness, contamination of images can be suppressed because even if the higher-brightness coloring material which has adhered to the porous layer adheres to a subsequent first image, it is less conspicuous.

[4] Ink Applying Unit 104

The transfer type ink jet recording apparatus has an ink applying unit 104 for applying an ink to the transfer body 101.

The ink applying unit preferably ejects an ink from an ink jet system recording head and applies the ink to a recording medium. Examples of an ink ejection system include application of dynamic energy to an ink and application of thermal energy to an ink. Of these, an ink ejection system which applies thermal energy to an ink is preferred.

The recording head is a line type one arranged along the direction Y and has ejection orifices of an ink arranged over the entire region in the width direction of the recording medium. The recording head has an ejection orifice surface with ejection orifice rows and a space between the ejection orifice surface and the transfer body 101 facing therewith can be set at about several mm.

The ink applying unit 104 is required to apply, to the transfer body, the first ink with lower brightness and the second ink with higher brightness in order of mention. It is therefore necessary to place, in a rotation direction of the surface of the transfer body 101 located between an ejection orifice of a recording head and a rotation axis 102*a* at a position corresponding to the ejection orifice in the Y axis direction, a first ink-ejecting recording head (first recording head) on the upstream side of the ink applying unit. Further, it is necessary to place a second ink-ejecting recording head (second recording head) on the downstream side of the ink applying unit. The ink applying unit may have a plurality of recording heads for applying an ink other than the first and second inks. In the ink jet recording method of the invention, it is important that the second ink with higher brightness is present on the surface side of the first image. The recording head for ejecting another ink is preferably placed on the upstream side of the first recording head or between the first recording head and the second recording head. The first ink and the second ink overlapped in this order are preferably applied to the first recording medium so as to overlap at least partially with the region to which the reaction liquid has been applied. A unit region of the first recording medium preferably includes a region to which the reaction liquid, the first ink and the second ink overlapping one another have been applied.

[5] Liquid Absorption Unit 105

The liquid absorption unit 105 has a liquid absorption member 105*a* and a pressing member 105*b* for liquid absorption for pressing the liquid absorption member 105*a* against the first image of the transfer body 101. The liquid absorption member 105*a* and the pressing member 105*b* can have the following shapes, respectively. Examples include a constitution in which as shown in FIG. 1, the pressing member 105*b* has a columnar shape and the liquid absorption member 105*a* has a belt-like shape and the columnar pressing member 105*b* presses the belt-like liquid absorption member 105*a* against the transfer body 101 and a constitution in which the pressing member 105*b* has a columnar shape, the liquid absorption member 105*a* is attached to the surface around the columnar pressing member 105*b* and the liquid absorption member 105*a* possessed by the pressing member 105*b* is pressed against the transfer body. The liquid absorption member 105*a* has preferably a belt-like shape in consideration of a space in the ink jet recording apparatus. The liquid absorption unit 105 having the belt-like liquid absorption member 105*a* may have an extending member for extending the liquid absorption member 105*a*. A member indicated by 105*c* is an extending roller as the extending member. The pressing member 105*b* is also shown as a roller in FIG. 1 like the extending roller, but the pressing member is not limited to it.

The liquid absorption unit 105 causes the liquid absorption member 105*a* having a porous layer to absorb therein the liquid component contained in the first image by bringing the liquid absorption member 105*a* into contact with the first image by means of the pressing member 105*b*. As a method of causing absorption of the liquid component contained in the first image, as well as the present method of bringing the liquid absorption member into contact with the first image, a method by heating, a method by sending low-humidity air, and a method of reducing pressure may be used in combination. In addition, these methods may be applied to the first image before or after absorption of the liquid component to cause further absorption of the liquid component.

[Liquid Absorption Member]

Through contact with the first image, the porous layer possessed by the liquid absorption member 105*a* absorbs at least a portion of the liquid component from the first image. Such a liquid absorption member having a porous layer rotates in conjunction with rotation of the transfer body 101. The liquid absorption member therefore has preferably a shape permitting repetitive liquid absorption and examples include an endless belt-like shape and a drum-like shape. After a certain region of the liquid absorption member having such a shape comes into contact with the first image and absorbs the liquid component therefrom, the liquid absorption member rotates in a direction of the arrow B and this region moves from the position of the first image. Until the liquid absorption member continues rotating and this region comes into contact with a new first image, the liquid component absorbed from the previous first image and therefore contained in the porous layer is preferably removed from the porous member. The liquid component contained in the porous member can be removed by a method of absorbing it from the back surface of the porous member, a method of making use of a member squeezing the porous member, or the like. The liquid component is removed in such a manner so that when the certain region of the porous member comes into contact with a new first image, it can efficiently absorb the liquid component contained in this first image again.

[Porous Layer]

To achieve uniformly high air permeability, the porous layer is preferably thin. The air permeability can be expressed as a Gurley value specified by JIS P8117. The Gurley value is preferably 10 seconds or less. The Gurley value is preferably 1 second or more. Thinning of a porous body, however, leads to a decrease in the total void volume of the porous layer so that the maximum amount of the liquid component absorbed by the porous layer decreases, sometimes making it impossible to sufficiently absorb the liquid component contained in the first image. To achieve sufficient absorption of the liquid component contained in the first image, a porous body comprised of, in addition to the porous layer, some layers having a void greater than that of the porous layer can be used. The liquid absorption member is only required to have a porous layer as a layer to be brought into contact with the first image and a layer not brought into contact with the first layer is not necessarily a porous layer.

The porous body will next be described with a porous layer to be brought into contact with the first image as a first layer and a layer stacked on a surface of the first layer on a side opposite to the first image as a second layer. When it is made of a multilayer, the constitution of the multilayer will also be indicated successively in stacking order, starting with the first layer. In the present specification, the first layer may be called "absorption layer" and the second layer and layers subsequent thereto may be called "support layers".

<First Layer>

As a material constituting the first layer, either of a hydrophilic material having a contact angle with water of less than 90° or a water repellent material having a contact angle of 90° or more may be used. Examples of the hydrophilic material include fiber materials such as cellulose and resin material such as polyacrylamide resin and they may be used either singly or in combination. A water repellent material as described later may be used after hydrophilic treatment is given to its surface. Examples of the hydrophilic treatment include sputter etching, exposure to radiation or $H_2O$ ion, and exposure to excimer (ultraviolet) laser light.

When the hydrophilic material is used, it is preferably a hydrophilic material having a contact angle with water of 60° or less. The hydrophilic material has action of sucking up a liquid component, particularly water by its capillary force. From the viewpoint of suppressing adhesion of the coloring material to the first layer or enhancing the cleaning property, a water repellent resin or the like having low surface free energy is preferably used as a material of the first layer. Particularly, the first layer preferably contains a fluorine-based resin. Examples of the fluorine-based resin include polytetrafluoroethylene, polyvinylidene fluoride, polyvinyl fluoride, and polychlorotrifluoroethylene. The fluorine-based resin is particularly preferably polytetrafluoroethylene or polyvinylidene fluoride. Compared with olefin resins such as polypropylene and polyester-based resins such as polyethylene terephthalate, fluorine-based resins have low surface free energy and higher water repellency so that adhesion of the coloring material to the first layer can be suppressed more effectively.

When the water repellent material is used, on the other hand, action of sucking up the liquid component through capillary force hardly occurs different from the hydrophilic material so that it may take time for the water repellent material to suck up the liquid component. The first layer is therefore preferably impregnated with a treatment liquid having a contact angle with the first layer of less than 90°. The first layer can be impregnated with this treatment liquid by applying the liquid from the surface of the liquid absorption member to be brought into contact with an ink before the porous layer possessed by the liquid absorption member is brought into contact with the first image. The treatment liquid preferably contains water and a water soluble organic solvent. The water is preferably deionized water. As the water soluble organic solvent, an alcohol such as ethanol or isopropyl alcohol can be used. Alternatively, the treatment liquid may be prepared by mixing them with a component such as surfactant. Examples of a method of applying the treatment liquid include immersion and dropwise addition.

The first layer has preferably a thickness of 400 μm or less, more preferably 1 μm or more to 350 μm or less. The thickness of the first layer can be determined by measuring thickness at any 10 points with a micrometer and then calculating an average thereof. More specifically, a digimatic straight formula outside micrometer ("OMV-25MX", product name of Mitsutoyo Corporation) or the like can be used.

The first layer can be formed by a known method of forming a thin porous film. For example, it can be formed by extruding a resin material into a sheet and then stretching the resulting sheet into a predetermined thickness. It can also be formed as a porous film by adding a plasticizer such as paraffin to the material used in extrusion and then removing the plasticizer by heating or the like at the time of stretching. The pore size can be controlled by adjusting the addition amount of the plasticizer, a percent of stretch, or the like as needed.

<Second Layer>

The second layer preferably has air permeability. More specifically, it is nonwoven fabric, woven fabric or the like. Examples of a material constituting the second layer include materials having a contact angle with a second ink equal to or lower than that of the first layer to prevent the backflow of the liquid absorbed in the first layer. Specific examples include resin materials such as olefin resins and urethane resins. The pore size of the second layer is preferably larger than that of the first layer.

<Third Layer>

The porous layer may be comprised of three or more layers. As the third layer or layers subsequent thereto, use of nonwoven fabric is preferred from the standpoint of rigidity. Examples of a material constituting the third layer are similar to those of the second layer.

<Other Members>

The liquid absorption member may have, in addition to the porous body having the above-described stacked structure, a reinforcing member for reinforcing the side surface of the liquid absorption member. When a belt-shaped porous body is formed by connecting the sheet-shaped porous bodies at the longitudinal-direction ends thereof, a joining member such as tape made of a non-porous material may be used. The joining member may be placed preferably at a position not in contact with the first image or placed at regular intervals.

<Manufacturing Method of Porous Body>

As a method of manufacturing the porous body having a stacked structure, two or more layers may only be overlapped with each other or they may be bonded with an adhesive or heat. From the standpoint of air permeability, not bonding with an adhesive but bonding of a plurality of layers with heat is preferred. They may be bonded by heating to melt a portion of the layers or may be bonded to each other by interposing a fusing material such as hot melt powder between the layers and then heating. When three or more layers are stacked one after another, they may be stacked simultaneously or successively. In the latter case, the stacking order can be determined as needed. When heating is necessary for bonding two or more layers, they may be bonded while applying a pressure to the porous body with a heated roller. Various conditions and constitution in the liquid absorption unit 105 will next be described in detail.

<Pressure Applying Conditions>

When the pressure of the liquid absorption member to be brought into contact with the first image of the transfer body is 2.9 N/cm$^2$ (0.3 kg/cm$^2$) or more, solid-liquid separation of the liquid component contained in the first image can be achieved in a shorter time and the liquid component contained in the first image can be removed efficiently. The pressure of the liquid absorption member is a nip pressure between the transfer body and the liquid absorption member. It can be determined, for example, by measuring the surface pressure by means of a pressure distribution measurement system and dividing the load in a pressure applied region by an area. More specifically, a surface pressure distribution measurement system ("I-SCAN", product name of Nitta Corporation) or the like can be used.

<Contact Time>

Contact time for bringing the porous layer possessed by the liquid absorption member 105*a* into contact with the first image is preferably 50 msec or less in order to suppress adhesion of the coloring material to the porous layer as much as possible. The contact time can be determined by dividing the pressure detection width in the movement direction of the transfer body in the above-described surface pressure measurement by the movement speed of the transfer body.

[6] Pressing Member 106 for Transfer

After the liquid component is absorbed from the first image, the resulting first image is transferred to the recording medium 108 at the transfer unit 111. The constitution of the apparatus and conditions at the time of transfer will next be described.

By using the pressing member 106 for transfer, the first image is brought into contact with the recording medium 108, the first image is transferred to the recording medium and a second image is finally recorded. Since the first image from which the liquid component has been adsorbed is transferred to the recording medium, curling, cockling or the like can be suppressed effectively.

The pressing member 106 is required to have a certain degree of structural strength from the standpoint of conveyance accuracy or durability of the recording medium 108. Examples of a material constituting the pressing member 106 include metal materials, ceramic materials, and resin materials. Of these, metal materials such as aluminum are preferably used in view of rigidity enough to withstand the stress at the time of transfer, size accuracy and also reduction of the inertia during operation to improve the control responsivity. Alternatively, the above-described materials may be used in combination.

The time (pressing time) of pressing the transfer body with the pressing member 106 for transferring the first image to the recording medium 108 is preferably 5 msec or more to 100 msec or less from the standpoint of smooth transfer and suppression of the damage of the transfer body. The term "pressing time" means the time during which the recording medium 108 and the transfer body 101 are in contact. The pressing time can be determined by measuring the surface pressure by means of a pressure distribution measurement system and dividing the conveyance-direction length of the pressed region by a conveyance speed. More specifically, a surface pressure distribution measurement system ("I-SCAN", product name of Nitta Corporation) or the like can be used.

The pressure of pressing (pressing force) the transfer body 101 with the pressing member 106 for transferring the first image to the recording medium 108 is preferably a pressure under which transfer is performed smoothly and at the same time, damage of the transfer body is suppressed. The pressure is therefore preferably 9.8 N/cm$^2$ (1 kg/cm$^2$) or more to 294.2 N/cm$^2$ (30 kg/cm$^2$) or less. The term "pressing force" means a nip pressure between the recording medium 108 and the transfer body 101. The pressing force can be determined by measuring the surface pressure by means of a pressure distribution measurement system and dividing a load in the pressed region by an area. More specifically, a surface pressure distribution measurement system ("I-SCAN", product name of Nitta Corporation) or the like can be used.

The temperature at the time when the pressing member 106 presses the transfer body 101 for transferring the first image to the recording medium 108 is preferably the glass transition point or more or the softening point or more, each of the resin component contained in the first image. Depending on the properties of the resin component, however, a heating unit for heating the first image of the transfer body 101, the transfer body 101, and the recording medium 108 is preferably provided for temperature adjustment. Examples of the shape of the pressing member 106 include a roller shape.

[7] Recording Medium 108

Examples of the recording medium 108 include a sheet which may be wound into a roll and a sheet cut into a predetermined size. Examples of a material constituting the recording medium 108 include films made of paper, plastics or a metal, wood boards and corrugated boards.

[8] Recording Medium Conveyance Unit 107

The recording medium conveyance unit 107 for conveying the recording medium 108 in the direction of the arrow C may be any unit insofar as it can convey the recording medium and as shown in FIG. 1, it can be comprised of a recording medium delivery roller 107*a* and a recording medium winding roller 107*b*. The conveyance speed of the recording medium 108 is preferably determined in consideration of the speed required in each step.

<Direct Recording Type Ink Jet Recording Apparatus>

Figure 2:
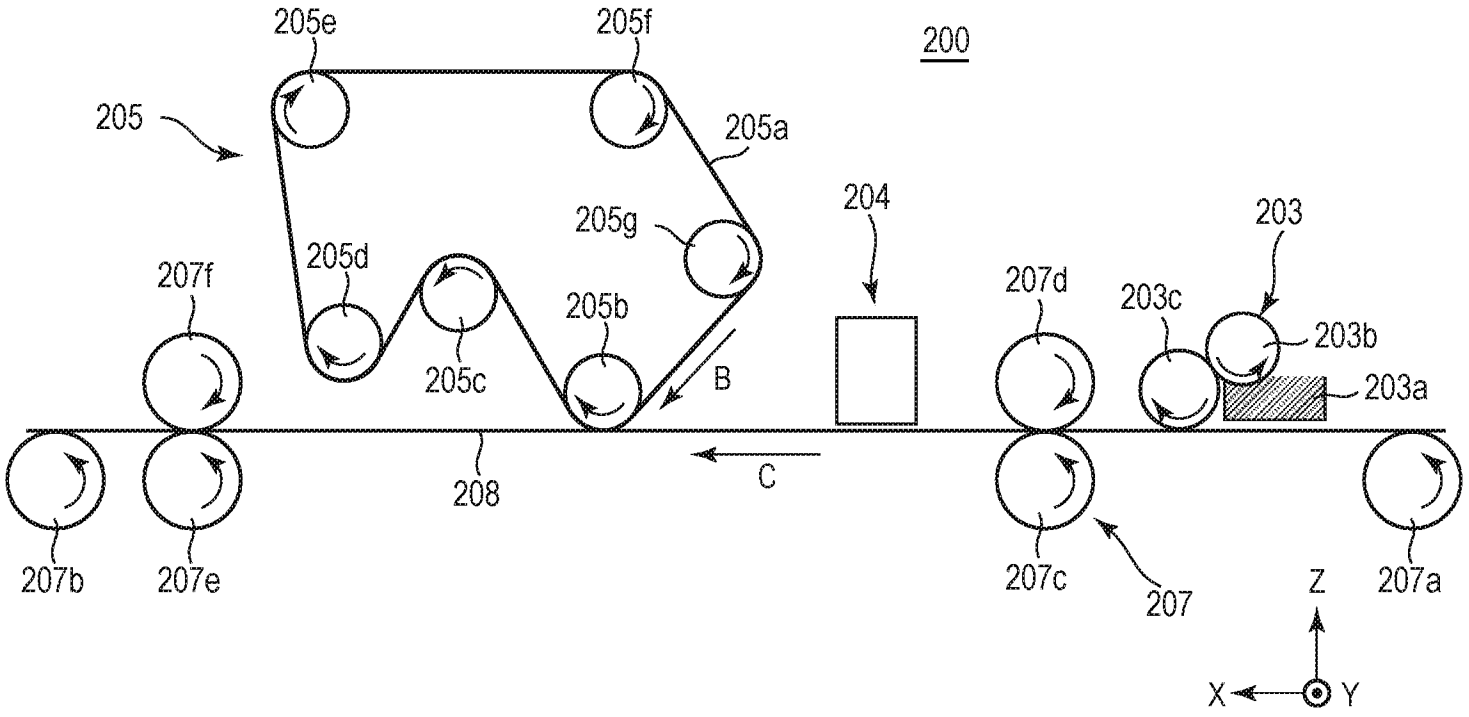
FIG. 2 is a schematic view showing one example of a direct recording type ink jet recording apparatus to be used in the ink jet recording method of the invention.

FIG. 2 is a schematic view showing one example of a direct recording type ink jet recording apparatus to be used in the ink jet recording method of the invention. A first recording medium used in the direct recording type ink jet recording apparatus 200 is not a transfer body but a generally used recording medium. When used in the transfer type apparatus, it is a "recording medium onto which a first image is transferred". Different from the above-described transfer type ink jet recording apparatus, the direct recording type ink jet recording apparatus has none of the transfer body 101, the support member 102, the pressing member 106 for transfer and the transfer body cleaning member 109. It forms a first image on a recording medium 208 and finally records a second image. Units and members other than those described above such as a reaction liquid applying unit 203, an ink applying unit 204, a liquid absorption unit 205 for absorbing a liquid component contained in the first image by means of a liquid absorption member 205*a* and the recording medium 208 can each have a constitution similar to that of the transfer type ink jet recording apparatus.

In FIG. 2, shown as the reaction liquid applying unit 203 is a gravure offset roller having a reaction liquid storage unit 203*a* for storing therein the reaction liquid and reaction liquid applying members 203*b* and 203*c* for applying the reaction liquid in the reaction liquid storage unit 203*a* to the recording medium 208. The liquid absorption unit 205 has the liquid absorption member 205*a* rotating in the direction of the arrow B and a pressing member 205*b* for liquid absorption for pressing the liquid absorption member 205*a* against the first image of the recording medium 208. The shapes of the liquid absorption member 205*a* and the pressing member 205*b* are similar to those of the transfer type, respectively. The liquid absorption unit 205 may have an extending member for extending the liquid absorption member. In FIG. 2, extending rollers as the extending member are indicated by 205*c*, 205*d*, 205*e*, 205*f* and 205*g*, respectively. The number of the extending rollers is not limited to five as shown in FIG. 2 and the required number of them may be placed according to the constitution or size of the unit. The ink applying unit for applying an ink to the recording medium 208 by means of the ink applying unit 204 and the liquid absorption unit for bringing the liquid absorption member 205*a* into contact with the first image of the recording medium to absorb the liquid component therefrom may be provided with a recording medium support member, not shown in the drawing, for supporting the recording medium from the back surface thereof. Examples of the recording medium conveyance unit 207 for conveying the recording medium 208 in the direction of the arrow C have a recording medium delivery 207*a*, a recording medium winding roller 207*b* and recording medium conveyance rollers 207*c*, 207*d*, 207*e* and 207*f* as shown in FIG. 2.

<Reaction Liquid>

Components constituting the reaction liquid to be used in the invention will hereinafter be described in detail. The content (mass %) of the coloring material in the reaction liquid is preferably 0.1 mass % or less based on the total mass of the reaction liquid, with 0.0 mass % being more preferred. The reaction liquid preferably contains no coloring material.

(Reactant)

The reaction liquid serves to aggregate anionic group-containing components (resin, self-dispersible pigment, and the like) in the ink through the contact with the ink and it contains a reactant. Examples of the reactant include multivalent metal ions, cationic components such as cationic resin and organic acids.

Examples of the multivalent metal ions include divalent metal ions such as $Ca^{2+}$, $Cu^{2+}$, $Ni^{2+}$, $Mg^{2+}$, $Sr^{2+}$, $Ba^{2+}$ and $Zn^{2+}$ and trivalent metal ions such as $Fe^{3+}$, $Cr^{3+}$, $Y^{3+}$ and $Al^{3+}$. In order to incorporate the multivalent metal ion in the reaction liquid, a multivalent metal salt (which may be a hydrate) obtained by bonding between the multivalent metal ion and an anion can be used. Examples of the anion include inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$ and $H_2PO_4^-$ and organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$. When the multivalent metal ion is used as the reactant, the content (mass %) of it in the reaction liquid in terms of a multivalent metal salt is preferably 1.0 mass % or more to 20.0 mass % or less based on the total mass of the reaction liquid.

The reaction liquid containing an organic acid has buffering capacity in an acid region (less than pH 7.0, preferably from pH 2.0 to 5.0) so that it converts the anionic group of the component present in the ink into an acid form and causes aggregation. Examples of the organic acid include monocarboxylic acids such as formic acid, acetic acid, propionic acid, butyric acid, benzoic acid, glycolic acid, lactic acid, salicylic acid, pyrrole carboxylic acid, furan carboxylic acid, picolinic acid, nicotinic acid, thiophene carboxylic acid, levulinic acid and coumaric acid and salts thereof; dicarboxylic acids such as oxalic acid, malonic acid, succinic acid, glutaric acid, adipic acid, maleic acid, fumaric acid, itaconic acid, sebacic acid, phthalic acid, malic acid and tartaric acid and salts or hydrogen salts thereof; tricarboxylic acids such as citric acid and trimellitic acid and salts or hydrogen salts thereof; and tetracarboxylic acids such as pyromellitic acid and salts or hydrogen salts thereof. Of these, the organic acid is preferably at least one of the dicarboxylic acids and salts or hydrogen salts thereof and the tricarboxylic acids and salts or hydrogen salts thereof. The content (mass %) of the organic acid in the reaction liquid is preferably 1.0 mass % or more to 50.0 mass % or less, more preferably 15.0 mass % or more to 45.0 mass % or less, each based on the total mass of the reaction liquid.

Examples of the cationic resin include resins having a primary to tertiary amine structure and resins having a quaternary ammonium salt structure. Specific examples include resins having a structure of vinylamine, allylamine, vinylimidazole, vinylpyridine, dimethylaminoethyl methacrylate, ethyleneimine or guanidine. The cationic resin may be used in combination with an acid compound or may be subjected to quaternization treatment to enhance its solubility in the reaction liquid. When the cationic resin is used as the reactant, the content (mass %) of the cationic resin in the reaction liquid is preferably 1.0 mass % or more to 40.0 mass % or less, more preferably 1.0 mass % or more to 10.0 mass % or less, each based on the total mass of the reaction liquid.

The reactant is particularly preferably an organic acid. Hydrogen ions have a radius smaller than that of multivalent metal ions so that hydrogen ions released from the organic acid move smoothly in the liquid component contained in the first image. When the reaction liquid and then the ink are applied to the first recording medium, hydrogen ions released from the organic acid can approach an anionic group-containing component in the ink and cause aggregation of the component in the ink speedily. Even under conditions where the liquid absorption member is used repeatedly, therefore, adhesion of the coloring material to the porous layer can be suppressed and images thus obtained can be prevented effectively from contamination. Further, compared with a cationic resin which is a polymer, hydrogen ions move smoothly in the liquid component contained in the first image. Therefore, with the same reason, adhesion of the coloring material to the porous layer can be suppressed and images thus obtained can be prevented more effectively from contamination.

(Surfactant)

The reaction liquid preferably contains a surfactant. The surfactant is preferably at least one of a fluorine-based surfactant and a silicone-based surfactant. When the reactant in the reaction liquid is an organic acid, the content (mass %) of the fluorine-based surfactant and/or the silicone-based surfactant is preferably 2.0 mass % or more to 10.0 mass % or less, more preferably 2.0 mass % or more to 8.0 mass % or less, each based on the total mass of the reaction liquid.

First, a fluorine-based surfactant will be described in detail. A fluorine-based surfactant represented by $C_xF_{2x+1}$—$(CH_2)_y$—$(OCH_2CH_2)_z$—OH can be used preferably. In this formula, $C_xF_{2x+1}$ represents a perfluoroalkyl group; x that defines the number of carbon atoms and fluorine atoms of the perfluoroalkyl group is preferably 4 or more to 6 or less; y represents the number of alkylene groups and is preferably 1 or more to 6 or less; and z represents the number of ethylene oxide groups and is preferably 1 or more to 50 or less, more preferably 1 or more to 20 or less, further more preferably 1 or more to 10 or less, particularly preferably 4 or more to 6 or less.

Examples of the fluorine-based surfactant include Surflon S-242, S-243, and S-420 (each, product name of AGC Seimi Chemical); Megaface F-444 (product name of DIC Corporation); and Zonyl FS-300, FSN, FSO-100 and FS-3100 (each, product name of DuPont). Of these, the fluorine-based surfactant having 6 as x, more specifically, at least one selected from the group consisting of Megaface F-444 and Zonyl FS-3100 is preferred.

Next, the silicone-based surfactant will be described in detail. As the silicone-based surfactant, that having a hydrophilic siloxane (—Si—O—) unit having a polyether chain and a hydrophobic siloxane unit having no polyether chain is preferred. Some silicone-based surfactants have a main chain with a polyether chain bonded thereto and some ones have a side chain with a polyether chain bonded thereto. The structure of the polyether chain is represented by —O—$(C_2H_4O)_a$—$(C_3H_6O)_b$—R, in which a stands for an integer of 1 or more, b stands for an integer of 0 or more, R represents a hydrogen atom or an alkyl group having 1 or more to 20 or less carbon atoms, $C_2H_4O$ is an ethylene oxide group and $C_3H_6O$ is a propylene oxide group. In a polyether-modified siloxane compound, ethylene oxide units and propylene oxide units may be present in any form in the structure of the compound, for example, at random or in block. Presence of these units at random means irregular arrangement of ethylene oxide units and propylene oxide units. Presence of these units in block means regular arrangement of blocks each comprised of some of the above-described units. Examples of the silicone-based surfactant include BYK-349, BYK-333 and BYK-3455 (each, product name of BYK). Of these, a silicone-based surfactant having a side chain with a polyether chain bonded thereto, more specifically, BYK-349 is preferred.

(Other Components)

As the other components, components similar to those exemplified later as the water-soluble organic solvent, the aqueous medium and the other additive usable in the ink may be used.

<Ink>

Components constituting the ink (first ink and second ink) to be used in the invention will next be described in detail. When the ink is described without distinguishing between the first ink and the second ink, there is no difference in the constitution.

The first ink and the second ink may have respectively different hues or the same hue. The first ink and the second ink may be used in any combination of hues insofar as they satisfy the relationship in brightness. The hue of the first ink and the second ink can be selected from black, cyan, magenta, yellow, orange, green, blue and the like. When the hue is different, inks can be arranged as follows in an ascending order of brightness: a black ink, a blue ink, an orange ink, a cyan ink, a magenta ink and a yellow ink. When the first ink and the second ink have the same hue, they are a dark ink and a light ink, respectively. In this case, inks can be arranged as follows in an ascending order of brightness: a dark ink having a black hue (black ink), a dark ink having a cyan hue (cyan ink), a dark ink having a magenta hue (magenta ink), a light ink having a black hue (gray ink), a light ink having a cyan hue (light cyan ink) and a light ink having a magenta hue (light magenta ink). A yellow ink has generally brightness higher than that of gray ink. The first ink is preferably a black ink which has lower brightness among the above-exemplified inks. Further, the first ink and the second ink have preferably the same hue. The density therefore gradually changes from a light image portion to a dense image portion so that an image excellent in gradation can be obtained.

(Coloring Material)

As the coloring material, pigments or dyes can be used. Of these, pigments are preferred. The content of the coloring material in the ink is preferably 0.2 mass % or more to 15.0 mass % or less based on the total mass of the ink.

When the first ink and the second ink have the same hue, a ratio of the content (mass %) of the coloring material in the first ink to the content (mass %) of the coloring material in the second ink is preferably 1.5 times or more to 8.0 times or less. Further, when the first ink and the second ink have the same hue, the content (mass %) of the coloring material in the second ink is preferably 1.5 mass % or less. When the content exceeds 1.5 mass %, the coloring material adheres to the porous layer during contact of the porous layer with the first image to absorb a liquid component from the first image. Contact of the porous layer to which the coloring material has adhered with a subsequent first image inevitably causes adhesion of the coloring material also to this subsequent first image, which may result in failure in sufficiently preventing contamination of images.

As the pigment, when classified by a dispersing method, a resin-dispersible pigment using a resin as a dispersant or a self-dispersible pigment having a hydrophilic group-bonded particle surface can be used. As well, a resin bonded pigment obtained by chemically bonding a resin-containing organic group to the particle surface of the pigment or a microcapsule pigment having a particle surface coated with a resin or the like can be used.

The resin dispersant for dispersing a pigment in an aqueous medium is preferably that capable of dispersing a pigment in an aqueous medium by the action of its anionic group. As the resin dispersant, resins described later can be used preferably, with water-soluble resins being more preferred. A mass ratio of the content (mass %) of the pigment to the content of the resin dispersant (pigment/resin dispersant) is preferably 0.3 times or more to 10.0 times or less.

As the self-dispersible pigment, usable are those having an anionic group such as carboxylic acid group, sulfonic acid group or phosphonic acid group bonded to the surface of pigment particles directly or via another atomic group (—R—). The anionic group may be present in either of an acid or salt form. In the latter case, either a portion or the whole of the salt may be dissociated. Examples of a cation which is the counter ion of the anionic group in salt form include alkali metal cations, ammonium and organic ammoniums. Specific examples of the another atomic group (—R—) include linear or branched alkylene groups having 1 to 12 carbon atoms, arylene groups such as phenylene and naphthylene, carbonyl groups, imino groups, amide groups, sulfonyl groups, ester groups and ether groups. As the another atomic group, these groups may be used in combination. Of these pigments, the resin-dispersible pigments are preferably used.

Examples of the pigment for the ink having a black hue include carbon black.

Examples of the pigment for the ink having a cyan hue include C.I. Pigment Blue 15:3 and C.I. Pigment Blue 15:6.

Examples of the pigment for the ink having a magenta hue include C.I. Pigment Red 122, C.I. Pigment Red 202, C.I. Pigment violet 23 and a solid solution of a plurality of quinacridone pigments.

Examples of the pigment for the ink having a yellow hue include C.I. Pigment Yellow 128 and C.I. Pigment Yellow 74, 155, 180 and 213.

Examples of the pigment for the ink having an orange to red hue include C.I. Pigment Orange 43 and 64 and C.I. Pigment Red 255, 264 and 272.

Examples of the pigment for the ink having a green hue include C.I. Pigment Green 7 and 36 and C.I. Pigment Green 58.

Examples of the pigment for the ink having a blue hue include C.I. Pigment Violet 19 and C.I. Pigment Violet 23.

Of these, the pigment is preferably selected from carbon black, C.I. Pigment Blue 15:3, a solid solution of a plurality of quinacridone pigments, C.I. Pigment Yellow 74, C.I. Pigment Orange 43, C.I. Pigment Green 7 and 36 and C.I. Pigment Violet 23. The relationship in brightness between the inks is the same insofar as the pigments fall within a stably usable range in an ink jet recording method using a water-based ink and they can be classified into the above-described seven hues. The relationship in brightness between the inks having the same hue differs depending on the kind of the pigment. The relationship in brightness between the inks can be found by measuring the brightness of them diluted at a predetermined dilution ratio but the brightness of the ink sometimes changes depending on the content of the coloring material in the ink.

(Resin)

The resin can be added to the ink for the purpose of (i) stabilizing the dispersion state of the pigment, that is, serving as the above-described resin dispersant or an auxiliary agent thereof, (ii) improving various properties of an image to be recorded, and the like. Examples of the form of the resin include block copolymers, random copolymers and graft copolymers, and combinations thereof. The resin may be dissolved as a water-soluble resin in an aqueous medium or dispersed as resin particles in an aqueous medium. The resin particles do not necessarily embrace the coloring material therein.

In the invention, when the resin is water soluble, it means that by neutralization of the resin with an alkali equivalent to the acid value of the resin, the resin does not form particles whose particle size can be measured by a dynamic light scattering method. Whether the resin is water soluble or not can be determined by the following method. First, a liquid containing a resin (resin solid content: 10 mass %) neutralized with an alkali (sodium hydroxide, potassium hydroxide, or the like) equivalent to an acid value is prepared. Then, the liquid thus prepared is diluted to 10 times (based on volume) with pure water to prepare a sample solution. The particle size of the resin in the sample solution is measured by the dynamic light scattering method. If particles with a particle size are not measured, the resin can be determined as water soluble. The measurement conditions at this time can be set, for example, as follows: SetZero: 30 seconds, measurement times: 3, and measurement time: 180 seconds. As a particle size distribution analyzers, a dynamic light scattering particle size analyzer (for example, "UPA-EX150"; product name of NIKKISO) can be used. It is needless to say that the particle size distribution analyzer and measurement conditions are not always limited to the above-described ones.

The weight average molecular weight of the resin, when it is water soluble, is preferably 3,000 or more to 15,000 or less, while that of resin particles is preferably 1,000 or more to 2,000,000 or less. The volume-based cumulative particle size at 50% of the resin particles as measured by the dynamic light scattering method (under measurement conditions similar to those described above) is preferably 100 nm or more to 500 nm or less.

Examples of the resin include acrylic resins, urethane resins and olefin resins. Of these, acrylic resins and urethane resins are preferred.

Acrylic resins have preferably a hydrophilic unit and a hydrophobic unit as a constitution unit. Of these, acrylic resins having a hydrophilic unit derived from (meth)acrylic acid and a hydrophobic unit derived from at least one of an aromatic ring-containing monomer and a (meth)acrylate-based monomer are preferred. Particularly preferred are resins having a hydrophilic unit derived from (meth)acrylic acid and a hydrophobic unit derived from at least one of styrene and α-methylstyrene monomers. These resins easily cause interaction with the pigment so that they can preferably be used as a resin dispersant for dispersing the pigment.

The hydrophilic unit is a unit having a hydrophilic group such as anionic group. The hydrophilic unit can be formed, for example, by polymerizing a hydrophilic monomer having a hydrophilic group. Specific examples of the hydrophilic monomer having a hydrophilic group include acidic monomers having a carboxylic acid group such as (meth) acrylic acid, itaconic acid, maleic acid or fumaric acid and anionic monomers such as anhydrides or salts of these acidic monomers. Examples of a cation constituting the salt of the acidic monomer include ions such as lithium, sodium, potassium, ammonium, and organic ammonium. The hydrophobic unit does not have a hydrophilic group such as anionic group. The hydrophobic unit can be obtained by polymerizing a hydrophobic monomer having no hydrophilic group such as anionic group. Specific examples of the hydrophobic monomer include aromatic ring-containing monomers such as styrene, α-methylstyrene and benzyl (meth)acrylate and (meth)acrylate-based monomers such as methyl (meth)acrylate, butyl (meth)acrylate and 2-ethylhexyl (meth)acrylate.

The urethane resin can be obtained, for example, by reacting a polyisocyanate with a polyol. It may be obtained by reacting, in addition to them, with a chain extending agent. Examples of the olefin resins include polyethylene and polypropylene.

[Resin Particles]

The second ink preferably contains resin particles. Since the second ink contains resin particles, the resin particles and the coloring material aggregate together as the liquid component contained in the first image is absorbed. In particular, the resin particles are contained in the second ink present on the surface side of the first image which comes into contact with the porous layer so that the resin particles in the second ink contained in the first image aggregate together with the coloring material. This makes it possible to more effectively prevent adhesion of the coloring material to the porous layer. Even if the porous layer comes into contact with a subsequent first image, therefore, images thus formed can be more effectively protected from contamination. Particularly, the resin particles preferably contain an anionic group. Though depending on the kind of a reactant, the anionic group-containing resin particles may react with the reactant and accelerate aggregation of the resin particles. The resin particles together with the coloring material therefore aggregate strongly and adhesion of the coloring material to the porous layer can be suppressed more effectively. As a result, even when the porous layer comes into contact with a subsequent first image, images thus obtained can be more effectively protected from contamination.

A ratio of the content (mass %) of the coloring material in the second ink to the content (mass %) of the resin particles is preferably 0.20 times or less, more preferably 0.03 times or more. The first ink also preferably contains anionic group-containing resin particles.

The content (mass %) of the resin particles in the ink is preferably 1.0 mass % or more to 20.0 mass % or less, more preferably 2.0 mass % or more to 15.0 mass % or less, each based on the total mass of the ink. When the content of the resin particles is less than 1.0 mass %, the resin layer thus formed is thin and it easily deforms due to repeated contact of the porous layer with the first image. Deformation of the resin layer in the first image exposes the coloring material layer and due to the contact between the exposed coloring material layer and the porous layer, adhesion of the coloring material to the porous layer cannot always be suppressed sufficiently. When the content of the resin particles exceeds 20.0 mass %, on the other hand, the thick resin layer thus formed hinders smooth absorption of the liquid component from the first image and curling or cockling caused by absorption of the liquid component in the recording medium cannot always be suppressed sufficiently.

The resin particles can be selected from those exemplified above as components of the acrylic resin or urethane resin.

(Water-Soluble Resin)

The second ink preferably contains a water-soluble resin having an anionic group. Since the second ink contains an anionic group-containing water-soluble resin, aggregation of resin particles is accelerated further via the water-soluble resin. Aggregation of the resin particles while including the coloring material is accelerated so that adhesion of the coloring material to the porous layer can be suppressed more effectively. Even if the porous layer comes into contact with subsequent first images, this makes it possible to more effectively suppress contamination of images thus obtained. The first ink also preferably contains an anionic group-containing water-soluble resin.

A mass ratio of the content (mass %) of the water-soluble resin in the ink to the content (mass %) of the resin particles is preferably 0.05 times or more to 0.50 times or less. The mass ratio less than 0.05 times, meaning that a ratio of the water-soluble resin is small with respect to the resin particles, cannot easily enhance the strength of the resin layer made of the resin particles and therefore cannot always suppress the adhesion of the coloring material to the porous layer to be brought into contact with the resin layer sufficiently. The mass ratio exceeding 0.50 times, meaning that a ratio of the water-soluble resin is large with respect to the resin particles, on the other hand, tends to increase the strength of the resin layer. Even after repeated contact of the porous layer with the first image, therefore, the resin layer itself hardly peels and adhesion of the ink to the porous layer can be suppressed more effectively. A decrease in the liquid component contained in the first image due to contact of the porous layer with the first image however causes aggregation of the water-soluble resin while including the coloring material in the ink. A volume shrinkage caused by aggregation of the ink component cannot always prevent the movement of the image sufficiently.

The water-soluble resin can be selected from those exemplified above as the component of the acrylic resin or urethane resin.

When the first ink and the second ink have the same hue, a ratio of the solid content (mass %) in the first ink to the solid content (mass %) in the second ink is preferably 0.75 times or more to 1.35 times or less. The term "solid content" as used herein means a total content of the coloring material, the resin particles, and the water-soluble resin. This water-soluble resin includes a water-soluble resin serving as a dispersant for dispersing the colorant. The solid content within the above-described range tends to make the reactivity of the first ink equal to that of the second ink and can more effectively suppress color unevenness of images thus obtained.

(Aqueous Medium)

The ink may contain water or an aqueous medium which is a mixed solvent of water and a water soluble organic solvent. The water is preferably deionized water or ion exchanged water. The content (mass %) of the water in the water-based ink is preferably 50.0 mass % or more to 95.0 mass % or less based on the total mass of the ink. The content (mass %) of the water-soluble organic solvent in the water-based ink is preferably 3.0 mass % or more to 50.0 mass % or less based on the total mass of the ink. As the water-soluble organic solvent, any of those usable for ink jet inks such as alcohols, (poly)alkylene glycols, glycol ethers, nitrogen-containing compounds, and sulfur-containing compounds can be used.

(Other Additives)

The ink may contain, in addition to the above-described components, various additives such as antifoam agent, surfactant, pH adjuster, viscosity modifier, rust inhibitor, antiseptic, fungicide, antioxidant and anti-reduction agent as needed.

(Physical Properties)

The surface tension at 25° C. of the ink is preferably 25.0 mN/m or more to 35.0 mN/m or less. A difference in surface tension at 25° C. between the first ink and the second ink is preferably 3.5 mN/m or less, more preferably 0.0 mN/m or more to 1.0 mN/m or less. The viscosity at 25° C. of the ink is preferably 2.5 mPa·s or more to10.0 mPa·s or less, more preferably 3.0 mPa·s or more to 8.0 mPa·s or less. A difference in viscosity at 25° C. between the first ink and the second ink is preferably 2.5 mPa·s or less, more preferably 0.0 mPa· or more to 1.5 mPa·s or less.

EXAMPLES

The invention will hereinafter be described in further detail by Examples, Comparative Examples and Referential Examples. The invention is not limited by the following Examples insofar as it does not depart from the gist of the invention. With respect to the amount of components, all designations of "part or parts" and "%" are on a mass basis unless otherwise particularly indicated.

<Preparation of Reaction Liquid>

Components described in Table 1 were mixed and stirred sufficiently. Then, the reaction mixture was pressure filtered through Micro Filter having a pore size of 3.0 μm (product name of Fujifilm) to prepare a reaction liquid. Zonyl FS-3100 (trade name) is a nonionic fluorine-based surfactant produced by DuPont. Megaface F-444 (trade name) is a nonionic fluorine-based surfactant produced by DIC. BYK-349 (trade name) is a nonionic silicone-based surfactant produced by BYK.

TABLE 1

| Composition of reaction liquid | | | | | | | | | | |
|---|---|---|---|---|---|---|---|---|---|---|
| | No. of reaction liquid | | | | | | | | | |
| | 1 | 2 | 3 | 4 | 5 | 6 | 7 | 8 | 9 | 10 |
| Malic acid | 30.0 | 30.0 | | | 15.0 | 45.0 | 30.0 | 30.0 | 30.0 | |
| Citric acid | | | 30.0 | | | | | | | |
| Malonic acid | | | | 30.0 | | | | | | |
| Calcium chloride | | | | | | | | | | 20.0 |
| glycerin | 7.0 | 7.0 | 7.0 | 7.0 | 7.0 | 7.0 | 7.0 | 7.0 | 7.0 | 5.0 |
| Zonyl FS-3100 | 5.0 | | 5.0 | 5.0 | 5.0 | 5.0 | 2.0 | | | |
| Megaface F-444 | | | | | | | | 2.0 | 10.0 | 1.0 |
| BYK-349 | | 5.0 | | | | | | | | |
| Acetylenol E100 | | | | | | | | | | |
| Ion exchanged water | 58.0 | 58.0 | 58.0 | 58.0 | 73.0 | 43.0 | 61.0 | 61.0 | 53.0 | 75.0 |

<Preparation of Pigment Dispersions>

(Pigment Dispersion 1)

To a solution obtained by dissolving 2.5 g of concentrated hydrochloric acid in 5.5 g of water, 0.8 g of p-aminobenzoic acid was added at 5° C. To the resulting solution was added a solution obtained by dissolving 0.9 g of sodium nitrite to 9.0 g of water, while stirring in ice bath to keep the temperature at 10° C. or less. After stirring for 15 minutes, 9.0 g of carbon black having a specific surface area of 220 $m^2/g$ and a DBP oil absorption amount of 105 mL/100 g was added and mixed. After stirring for further 15 minutes, the resulting slurry was filtered through a filter paper (Standard filter paper No. 2, product name of Advantec). The resulting carbon black was washed with water sufficiently and then, dried in an oven of 110° C. Water was added to the carbon black and Pigment dispersion 1 having a self-dispersible carbon black content of 20.0% was obtained.

(Pigment Dispersion 2)

A styrene-acrylic acid copolymer (Resin A: 6.4 parts) having an acid value of 120 mgKOH/g and a weight average molecular weight of 8,000 was neutralized with an aqueous sodium hydroxide solution equimolar to the acid value of the copolymer, followed by dissolution in ion exchanged water (13.6 parts). The resulting solution (an aqueous solution of Resin A) was mixed with 15.0 parts of carbon black having a specific surface area of 220 $m^2/g$ and a DBP oil absorption amount of 105 mL/100 g and 65.0 parts of ion exchanged water. The resulting mixture was dispersed for 3 hours in a batch type vertical sand mill (product name of Aimex) filled with 200.0 parts of zirconia beads having a particle size of 0.3 mm. The resulting dispersion was then centrifuged to remove crude particles and the residue was pressure filtered through Micro Filter having a pore size of 3.0 μm (product name of Fujifilm). By the above-described method, Pigment dispersion 2 (content of pigment: 15.0%, content of resin dispersant (Resin A): 6.4%) having resin-dispersible carbon black in water was obtained.

(Pigment Dispersions 3 to 16)

A pigment (C.I. Pigment Red 122, 10.0 parts), 9.4 parts of the aqueous solution of Resin A and 80.6 parts of pure water were mixed. The resulting mixture and 200 parts of zirconia beads having a diameter of 0.3 mm were charged in a batch type vertical sand mill (product of Aimex) and dispersed for 5 hours while cooling with water. Then, the resulting dispersion was centrifuged to remove crude particles, followed by pressure filtration through a cellulose acetate filter having a pore size of 3.0 μm (product of Advantec) to prepare Pigment dispersion 3 having a pigment content of 10.0% and a resin dispersant (Resin A) content of 3.0%.

In a manner similar to that used for the preparation of Pigment dispersion 3 with the exception that the pigment was replaced by those described in Table 2, Pigment dispersions 4 to 16 having a pigment content of 10.0% and a resin dispersant content of 3.0% were prepared. In Table 2, the solid solution of a plurality of quinacridone pigments is a solid solution of C.I. Pigment Red 202 and C.I. Pigment Violet 19.

TABLE 2

| Kind of pigment in Pigment dispersion | |
|---|---|
| | Kind of pigment in Pigment dispersion |
| Pigment dispersion 1 | Self-dispersible carbon black |
| Pigment dispersion 2 | Resin-dispersible carbon black |
| Pigment dispersion 3 | C.I. Pigment Red 122 |
| Pigment dispersion 4 | Solid solution of a plurality of quinacridone pigments |
| Pigment dispersion 5 | C.I. Pigment Blue 15:3 |
| Pigment dispersion 6 | C.I Pigment Blue 15:6 |
| Pigment dispersion 7 | C.I. Pigment Yellow 74 |
| Pigment dispersion 8 | C.I. Pigment Yellow 128 |
| Pigment dispersion 9 | C.I. Pigment Yellow 155 |
| Pigment dispersion 10 | C.I. Pigment Orange 43 |
| Pigment dispersion 11 | C.I. Pigment Orange 64 |
| Pigment dispersion 12 | C.I Pigment Green 7 |
| Pigment dispersion 13 | C.I. Pigment Green 36 |
| Pigment dispersion 14 | C.I. Pigment Green 58 |
| Pigment dispersion 15 | C.I Pigment Violet 23 |
| Pigment dispersion 16 | C.I. Pigment Violet 19 |

<Preparation of Resin Particle-Containing Liquid>

(Liquid Containing Resin Particles 1)

A solution was prepared by mixing 0.2 parts of potassium persulfate and 74.0 parts of ion exchanged water. Further, an emulsified product was prepared by mixing 24.0 parts of ethyl methacrylate, 1.5 parts of methacrylic acid and 0.3 parts of a reactive surfactant ("Aqualon KH-05", product name of DKS). In a nitrogen atmosphere, the resulting emulsified product was added dropwise to the resulting solution for one hour. A polymerization reaction was performed while stirring at 80° C., followed by stirring for further 2 hours. After cooling to room temperature, ion exchanged water and an aqueous potassium hydroxide solution were added to obtain a liquid containing anionic Resin particles 1 (resin content: 25.0%). Resin particles 1 were found to have a volume-based cumulative average particle size at 50% (nm) of 210 nm.

(Liquid Containing Resin Particles 2)

A liquid containing anionic Resin particles 2 (resin content: 25.0%) was obtained by adjusting the concentration of a urethane resin particle-containing commercially available aqueous dispersion ("Takelac WS-5000", product name of Mitsui Chemicals). Resin particles 2 were found to have a volume-based cumulative average particle size at 50% (nm) of 70 nm.

(Liquid Containing Resin Particles 3)

A solution was prepared by mixing 0.3 parts of potassium persulfate and 74.0 parts of ion exchanged water. Further, an emulsified product was prepared by mixing 23.0 parts of ethyl methacrylate, 2.3 parts of methoxypolyethylene glycol methacrylate ("Blemmer PME1000", product name of NOF Corporation) and 0.4 parts of a reactive surfactant ("Aqualon KH-05", product name of DKS). In a nitrogen atmosphere, the resulting emulsified product was added dropwise to the resulting solution for one hour. A polymerization reaction was performed while stirring at 80° C., followed by stirring for further two hours. After cooling to room temperature, ion exchanged water and an aqueous potassium hydroxide solution were added to obtain a liquid containing nonionic Resin particles 3 (resin content: 25.0%). Resin particles 3 were found to have a volume-based cumulative average particle size at 50% of 70 nm.

[Measurement of Volume-Based Cumulative Average Particle Size at 50% of Resin Particles]

The volume-based cumulative average particle size at 50% of resin particles is measured by means of a dynamic light scattering system particle size distribution analyzer ("Nanotrac UPA-EX150"; product name of NIKKISO) while using, as a sample, a resin particle-containing liquid having a resin particle content of 1.0% obtained by diluting a resin particle-containing liquid with pure water. Measurement conditions are as follows: SetZero: 30 seconds, measurement times: 3, measurement time: 180 seconds, shape: true sphere and refractive index: 1.6.

<Preparation of Liquid Containing Water-Soluble Resin 1>

A styrene-ethyl acrylate-acrylic acid copolymer prepared by a conventional method was neutralized with an aqueous potassium hydroxide solution equimolar to the acid value of the copolymer to prepare a liquid containing Water-soluble resin 1 having a resin content of 20.0%. The styrene-ethyl acrylate-acrylic acid copolymer has an acid value of 150 mgKOH/g and a weight average molecular weight of 8,000. Water-soluble resin 1 is anionic.

<Preparation of First Ink and Second Ink>

After mixing components shown in Tables 3 to 5 and sufficient stirring, the resulting mixtures were pressure filtered through a cellulose acetate filter having a pore size of 3.0 μm (product of Advantec) to prepare inks, respectively. Polyvinylpyrrolidone K-90 is a nonionic water-soluble resin produced by Tokyo Chemical Industry. Acetylenol E100 (trade name) is a nonionic surfactant produced by Kawaken Fine Chemicals. Pluronic L-31 (trade name) is a polyoxyethylene-polyoxypropylene copolymer produced by Adeka Corporation. The number following polyethylene glycol in the table is its number average molecular weight.

TABLE 3

| Composition of first ink | | | | | | | | | | | | | |
|---|---|---|---|---|---|---|---|---|---|---|---|---|---|
| | No. of first ink | | | | | | | | | | | | |
| | 1 | 2 | 3 | 4 | 5 | 6 | 7 | 8 | 9 | 10 | 11 | 12 | 13 |
| Pigment dispersion 1 | 17.5 | | | | | | | 2.5 | 9.0 | 17.5 | | | |
| Pigment dispersion 2 | | 23.3 | | | | | | | | | | | |
| Pigment dispersion 3 | | | | | 35.0 | | | | | | 5.0 | | |
| Pigment dispersion 4 | | | | | | 35.0 | | | | | | | |
| Pigment dispersion 5 | | | 35.0 | | | | | | | | | 5.0 | |
| Pigment dispersion 6 | | | | 35.0 | | | | | | | | | |
| Pigment dispersion 7 | | | | | | | | | | | | | 35.0 |
| Pigment dispersion 8 | | | | | | | | | | | | | |
| Pigment dispersion 9 | | | | | | | | | | | | | |
| Pigment dispersion 10 | | | | | | | | | | | | | |
| Pigment dispersion 11 | | | | | | | | | | | | | |
| Pigment dispersion 12 | | | | | | | | | | | | | |
| Pigment dispersion 13 | | | | | | | | | | | | | |
| Pigment dispersion 14 | | | | | | | | | | | | | |
| Pigment dispersion 15 | | | | | | | 35.0 | | | | | | |
| Pigment dispersion 16 | | | | | | | | | | | | | |
| Liquid containing Resin particles 1 | 32.0 | 32.0 | 32.0 | 32.0 | 32.0 | 32.0 | 32.0 | 40.0 | 32.0 | 18.0 | 40.0 | 40.0 | 32.0 |
| Liquid containing Resin particles 2 | | | | | | | | | | | | | |
| Liquid containing Resin particles 3 | | | | | | | | | | | | | |
| Liquid containing Water-soluble resin 1 | 6.3 | 6.3 | 6.3 | 6.3 | 6.3 | 6.3 | 6.3 | 6.0 | 6.3 | 6.3 | 6.0 | 6.0 | 6.3 |
| Polyvinylpyrrolidone K-90 | | | | | | | | | | | | | |
| Glycerin | 7.0 | 7.0 | 7.0 | 7.0 | 7.0 | 7.0 | 7.0 | 7.0 | 7.0 | 7.0 | 7.0 | 7.0 | 7.0 |
| Polyethylene glycol 1000 | 3.0 | 3.0 | 3.0 | 3.0 | 3.0 | 3.0 | 3.0 | 3.0 | 3.0 | 3.0 | 3.0 | 3.0 | 3.0 |
| Pluronic L-31 | 3.0 | 3.0 | 3.0 | 3.0 | 3.0 | 3.0 | 3.0 | 3.0 | 3.0 | 3.0 | 3.0 | 3.0 | 3.0 |
| Acetylenol E100 | 0.5 | 0.5 | 0.5 | 0.5 | 0.5 | 0.5 | 0.5 | 0.5 | 0.5 | 0.5 | 0.5 | 0.5 | 0.5 |
| Ion exchanged water | 30.7 | 24.9 | 13.2 | 13.2 | 13.2 | 13.2 | 13.2 | 38.0 | 39.2 | 44.7 | 35.5 | 35.5 | 13.2 |

TABLE 4

| Composition of second ink | | | | | | | | | | | | | | | | |
|---|---|---|---|---|---|---|---|---|---|---|---|---|---|---|---|---|
| | No. of second ink | | | | | | | | | | | | | | | |
| | 1 | 2 | 3 | 4 | 5 | 6 | 7 | 8 | 9 | 10 | 11 | 12 | 13 | 14 | 15 | 16 |
| Pigment dispersion 1 | 2.5 | | | | | | | | | | | | | | | |
| Pigment dispersion 2 | | 3.3 | | | | | | | | | | | | | | |
| Pigment dispersion 3 | | | 5.0 | | | | | | | | 35.0 | | | | | |
| Pigment dispersion 4 | | | | 5.0 | | | | | | | | | | | | |
| Pigment dispersion 5 | | | | | 5.0 | | | | | 35.0 | | | | | | |
| Pigment dispersion 6 | | | | | | 5.0 | | | | | | | | | | |
| Pigment dispersion 7 | | | | | | | 35.0 | | | | | | | | | |
| Pigment dispersion 8 | | | | | | | | 35.0 | | | | | | | | |
| Pigment dispersion 9 | | | | | | | | | 35.0 | | | | | | | |
| Pigment dispersion 10 | | | | | | | | | | | | | | | 35.0 | |
| Pigment dispersion 11 | | | | | | | | | | | | | | | | 35.0 |
| Pigment dispersion 12 | | | | | | | | | | | | 35.0 | | | | |
| Pigment dispersion 13 | | | | | | | | | | | | | 35.0 | | | |
| Pigment dispersion 14 | | | | | | | | | | | | | | 35.0 | | |
| Pigment dispersion 15 | | | | | | | | | | | | | | | | |
| Pigment dispersion 16 | | | | | | | | | | | | | | | | |
| Liquid containing Resin particles 1 | 40.0 | 40.0 | 40.0 | 40.0 | 40.0 | 40.0 | 32.0 | 32.0 | 32.0 | 32.0 | 32.0 | 32.0 | 32.0 | 32.0 | 32.0 | 32.0 |
| Liquid containing Resin particles 2 | | | | | | | | | | | | | | | | |
| Liquid containing Resin particles 3 | | | | | | | | | | | | | | | | |
| Liquid containing Water-soluble resin 1 | 6.0 | 6.0 | 6.0 | 6.0 | 6.0 | 6.0 | 6.3 | 6.3 | 6.3 | 6.3 | 6.3 | 6.3 | 6.3 | 6.3 | 6.3 | 6.3 |
| Polyvinylpyrrolidone K-90 | | | | | | | | | | | | | | | | |
| Glycerin | 7.0 | 7.0 | 7.0 | 7.0 | 7.0 | 7.0 | 7.0 | 7.0 | 7.0 | 7.0 | 7.0 | 7.0 | 7.0 | 7.0 | 7.0 | 7.0 |
| Polyethylene glycol 1000 | 3.0 | 3.0 | 3.0 | 3.0 | 3.0 | 3.0 | 3.0 | 3.0 | 3.0 | 3.0 | 3.0 | 3.0 | 3.0 | 3.0 | 3.0 | 3.0 |
| Pluronic L-31 | 3.0 | 3.0 | 3.0 | 3.0 | 3.0 | 3.0 | 3.0 | 3.0 | 3.0 | 3.0 | 3.0 | 3.0 | 3.0 | 3.0 | 3.0 | 3.0 |
| Acetylenol E100 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 |
| Ion exchanged water | 38.0 | 37.2 | 35.5 | 35.5 | 35.5 | 35.5 | 13.2 | 13.2 | 13.2 | 13.2 | 13.2 | 13.2 | 13.2 | 13.2 | 13.2 | 13.2 |

TABLE 5

| Composition of second ink | | | | | | | | | | | | | | | | |
|---|---|---|---|---|---|---|---|---|---|---|---|---|---|---|---|---|
| | No. of second ink | | | | | | | | | | | | | | | |
| | 17 | 18 | 19 | 20 | 21 | 22 | 23 | 24 | 25 | 26 | 27 | 28 | 29 | 30 | 31 | 32 |
| Pigment dispersion 1 | | | 2.5 | 2.5 | 2.5 | 2.5 | 2.5 | 2.5 | 7.5 | 6.0 | 10.0 | 6.0 | 6.0 | 17.5 | | |
| Pigment dispersion 2 | | | | | | | | | | | | | | | | |
| Pigment dispersion 3 | | | 2.0 | | | | | | | | | | | | | 35.0 |
| Pigment dispersion 4 | | | | | | | | | | | | | | | | |
| Pigment dispersion 5 | | | | | | | | | | | | | | | 35.0 | |
| Pigment dispersion 6 | | | | | | | | | | | | | | | | |
| Pigment dispersion 7 | | | 2.0 | | | | | | | | | | | | | |
| Pigment dispersion 8 | | | | | | | | | | | | | | | | |
| Pigment dispersion 9 | | | | | | | | | | | | | | | | |
| Pigment dispersion 10 | | | | | | | | | | | | | | | | |
| Pigment dispersion 11 | | | | | | | | | | | | | | | | |
| Pigment dispersion 12 | | | | | | | | | | | | | | | | |
| Pigment dispersion 13 | | | | | | | | | | | | | | | | |
| Pigment dispersion 14 | | | | | | | | | | | | | | | | |
| Pigment dispersion 15 | 35.0 | | | | | | | | | | | | | | | |
| Pigment dispersion 16 | | 35.0 | | | | | | | | | | | | | | |
| Liquid containing Resin particles 1 | 32.0 | 32.0 | 40.0 | | | | 32.0 | 32.0 | 40.0 | 40.0 | 40.0 | 24.0 | 20.0 | 32.0 | 32.0 | 32.0 |
| Liquid containing Resin particles 2 | | | | | | 32.0 | | | | | | | | | | |
| Liquid containing Resin particles 3 | | | | | 32.0 | | | | | | | | | | | |
| Liquid containing Water-soluble resin 1 | 6.3 | 6.3 | 6.0 | 6.0 | 6.0 | 6.0 | | | 6.0 | 6.0 | 6.0 | 6.0 | 6.0 | 6.3 | 6.3 | 6.3 |
| Polyvinylpyrrolidone K-90 | | | | | | | | 1.2 | | | | | | | | |
| Glycerin | 7.0 | 7.0 | 7.0 | 7.0 | 7.0 | 7.0 | 7.0 | 7.0 | 7.0 | 7.0 | 7.0 | 7.0 | 7.0 | 7.0 | 7.0 | 7.0 |
| Polyethylene glycol 1000 | 3.0 | 3.0 | 3.0 | 3.0 | 3.0 | 3.0 | 3.0 | 3.0 | 3.0 | 3.0 | 3.0 | 3.0 | 3.0 | 3.0 | 3.0 | 3.0 |
| Pluronic L-31 | 3.0 | 3.0 | 3.0 | 3.0 | 3.0 | 3.0 | 3.0 | 3.0 | 3.0 | 3.0 | 3.0 | 3.0 | 3.0 | 3.0 | 3.0 | 3.0 |
| Acetylenol E100 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 |
| Ion exchanged water | 13.2 | 13.2 | 34.0 | 78.0 | 46.0 | 46.0 | 52.0 | 50.8 | 33.0 | 34.5 | 30.5 | 50.5 | 54.5 | 30.7 | 13.2 | 13.2 |

<Manufacture of Porous Body of Liquid Absorption Member>

(Liquid Absorption Member 1)

As a first layer, a fibrillated porous layer was prepared by performing compression molding of emulsion polymerization particles of a crystallized fluorine-based resin (polytetrafluoroethylene) and stretching the molded product at the melting point or less. The first layer thus obtained had a thickness of 25.0 μm and an average pore size of 0.4 μm.

As a second layer, a layer was prepared by using a wet method while mixing an olefin resin (a material composed of single fibers of polyethylene and polypropylene). The second layer thus obtained had a thickness of 50.0 μm and an average pore size of 6.0 μm.

As a third layer, a polyolefin-based nonwoven fabric HOP60 (product name of Hirose Paper MFG Co.) was used. The first layer, second layer and third layer were thermally bonded to obtain a porous body.

(Liquid Absorption Member 2)

As a first layer, a fibrillated porous layer was prepared by performing compression molding of emulsion polymerization particles of a crystallized fluorine-based resin (polyvinylidene fluoride) and stretching the molded product at the melting point or less.

As a second layer, a layer was prepared by using a wet method while mixing an olefin resin (a material composed of single fibers of polyethylene and polypropylene).

As a third layer, a polyolefin-based nonwoven fabric HOP60 (product name of Hirose Paper MFG Co.) was used. The first layer, second layer and third layer were thermally bonded to obtain a porous body. The first layer and the second layer had a thickness and average pore size equal to those of Liquid absorption member 1.

(Liquid Absorption Member 3)

As a first layer, a fibrillated porous layer was prepared by performing compression molding of emulsion polymerization particles of a crystallized olefin resin (polypropylene) and stretching the molded product at the melting point or less. The first layer thus obtained had a thickness of 25.0 μm and an average pore size of 0.4 μm.

As a second layer, a layer was prepared by using a wet method while mixing an olefin resin (a material composed of single fibers of polyethylene and polypropylene). The second layer thus obtained had a thickness of 50.0 μm and an average pore size of 6.0 μm.

As a third layer, a polyolefin-based nonwoven fabric HOP60 (product name of Hirose Paper MFG Co.) was used. The first layer, second layer and third layer were thermally bonded to obtain a porous body.

[Measurement Method of Thickness and Average Pore Size of Layer]

The thickness (μm) and average pore size (μm) of the layer are values determined by observing the cross-section of the porous layer by a scanning electron microscope (SEM).

<Evaluation>

In the invention, evaluation is made with AA, A or B for an acceptable level and C for an unacceptable level based on the following criteria. Combinations of the reaction liquid, the first ink and the second ink to be used in each of Examples, Comparative Examples and Referential Examples are listed in Tables 6 and 7. Further, the evaluation results are also listed in Tables 6 and 7. In Tables 6 and 7, Y means that the relationship between the first ink and the second ink is satisfied and the brightness of the second ink is higher than that of the first ink and N means that the relationship between the first ink and the second ink is not satisfied.

Examples 1 to 51 and 53 to 58, Comparative Examples 1 and 2 and Referential Examples 1 to 14

By using the transfer type ink jet recording apparatus shown in FIG. 1, images were recorded. As the support member 102, a cylindrical drum made of aluminum was used. As the member of the surface layer of the transfer body 101, a 0.5-mm thick polyethylene terephthalate (PET) sheet coated with a 0.2-mm thick silicone rubber ("KE12", product name of Shin-Etsu Chemical) having a rubber hardness (Durometer Type A) of 40° was used. Plasma surface treatment was given to the surface by means of an atmospheric pressure plasma treatment apparatus ("ST-7000", product name of Keyence) under the following conditions: treatment distance: 5 mm, plasma mode: High and treatment rate: 100 mm/sec. Further, the resulting surface was immersed for 10 seconds in a solution obtained by diluting a commercially available neutral detergent containing a sodium alkylbenzenesulfonate with pure water to give its concentration of 3%. Then, the surface was dried to obtain a surface layer member of the transfer body 101. The transfer body 101 thus obtained was fixed to the support member 102 with a double-sided adhesive tape.

The reaction liquid was loaded in the reaction liquid applying unit 103 and 1.0 g/m$^2$ of it was applied to the transfer body 101 from the reaction liquid applying unit. In Comparative Example 1, the reaction liquid was not applied to the transfer body.

The first ink and the second ink were loaded in the ink applying unit 104 and by the thermal energy given to the inks, they were ejected to the transfer body 101 through an on demand system.

As the porous body to be used for the liquid absorption member 105*a* that manufactured as described above was used. The speed of the conveyance roller 105*c* for conveying the liquid absorption member was adjusted to be equal to the moving speed of the transfer body 101. The conveyance speed of the conveyance roller 105*c* was 0.4 m/s. Further, the liquid absorption member 105*a* was immersed in a treatment liquid containing 95.0 parts of ethanol and 5.0 parts of water to impregnate the voids of the porous body with the liquid. Then, the liquid was replaced by water. A pressure was applied to the pressing member 105*b* to give an average nip pressure, between the transfer body 101 and the liquid absorption member 105*a*, of 4 kg/cm$^2$. In Referential Examples 1 and 2, the liquid absorption step using the liquid absorption material was not performed.

Then, the recording medium 108 was conveyed using the recording medium delivery roller 107*a* and the recording medium winding roller 107*b* so as to make the conveyance speed equal to the moving speed of the transfer body 101 and the recording medium 108 was brought into contact with the first image between the transfer body 101 and the pressing member 106. The first image was thus transferred from the transfer body 101 to the recording medium 108. As the recording medium 108, coated paper (Aurora Coat coated paper, product name of Nippon Paper Industries) was used. In the present Examples, the nip pressure between the transfer body 101 and the pressuring member 106 was adjusted to 3 kg/cm$^2$.

Example 52

An image was recorded using the direct recording type ink jet recording apparatus as shown in FIG. 2. The reaction liquid applying unit 203, the ink applying unit 204, the conveyance speed of the recording medium and the liquid absorption unit 205 were operated under conditions similar to those of the transfer type ink jet recording apparatus. As the recording medium 208, cast-coat paper (Gloria pure white paper, product name of Gojo Paper Mfg) was used.

[Suppression of Contamination of Images]

When the transfer type ink jet recording apparatus was used, a first image having a first ink recording duty of 100% and a second ink recording duty of 100% was formed on the transfer body and then it was transferred to Aurora Coat coated paper to record an image (5 cm×5 cm solid image). When the direct recording type ink jet recording apparatus was used, on the other hand, an image (5 cm×5 cm solid image) having a first ink recording duty of 100% and a second ink recording duty of 100% was recorded on Gloria pure white paper. In the present Examples, an image recorded under the conditions of applying 3.0 ng of ink droplets to a unit region of 1/1,200 inch×1/1,200 inch at a resolution of 1,200 dpi×1,200 dpi is defined as an image having a recording duty of 100%.

By observing, after recording an image on a predetermined number of sheets of paper, adhesion of the coloring material to the image, contamination of images was evaluated based on the following evaluation criteria.

AA: No adhesion of the coloring material was observed even at the time of recording an image on 300 sheets of paper.

A: Adhesion of the coloring material was observed at the time of recording an image on 300 sheets of paper.

B: Adhesion of the coloring material was observed at the time of recording an image on 100 sheets of paper.

C: Adhesion of the coloring material was observed at the time of recording an image on 50 sheets of paper.

TABLE 6

Evaluation conditions and evaluation results

| | Evaluation conditions | | | | | | | |
|---|---|---|---|---|---|---|---|---|
| | Kind of reaction liquid | First ink No. | First ink Kind | Second ink No. | Second ink Kind | Relationship of brightness between first and second inks | Kind of liquid absorption member | Suppression of image contamination |
| Example 1 | 1 | 1 | Black ink | 1 | Gray ink | Y | 1 | AA |
| Example 2 | 2 | 1 | Black ink | 1 | Gray ink | Y | 1 | AA |
| Example 3 | 3 | 1 | Black ink | 1 | Gray ink | Y | 1 | AA |
| Example 4 | 4 | 1 | Black ink | 1 | Gray ink | Y | 1 | AA |
| Example 5 | 5 | 1 | Black ink | 1 | Gray ink | Y | 1 | AA |
| Example 6 | 6 | 1 | Black ink | 1 | Gray ink | Y | 1 | AA |
| Example 7 | 7 | 1 | Black ink | 1 | Gray ink | Y | 1 | AA |
| Example 8 | 8 | 1 | Black ink | 1 | Gray ink | Y | 1 | AA |
| Example 9 | 9 | 1 | Black ink | 1 | Gray ink | Y | 1 | AA |
| Example 10 | 10 | 1 | Black ink | 1 | Gray ink | Y | 1 | AA |
| Example 11 | 1 | 2 | Black ink | 1 | Gray ink | Y | 1 | AA |
| Example 12 | 1 | 1 | Black ink | 2 | Gray ink | Y | 1 | AA |
| Example 13 | 1 | 1 | Black ink | 3 | Light magenta ink | Y | 1 | AA |
| Example 14 | 1 | 1 | Black ink | 4 | Light magenta ink | Y | 1 | AA |
| Example 15 | 1 | 1 | Black ink | 5 | Light cyan ink | Y | 1 | AA |
| Example 16 | 1 | 1 | Black ink | 6 | Light cyan ink | Y | 1 | AA |
| Example 17 | 1 | 1 | Black ink | 7 | Yellow ink | Y | 1 | AA |
| Example 18 | 1 | 1 | Black ink | 8 | Yellow ink | Y | 1 | AA |
| Example 19 | 1 | 1 | Black ink | 9 | Yellow ink | Y | 1 | AA |
| Example 20 | 1 | 3 | Cyan ink | 1 | Gray ink | Y | 1 | AA |
| Example 21 | 1 | 4 | Cyan ink | 1 | Gray ink | Y | 1 | AA |
| Example 22 | 1 | 3 | Cyan ink | 3 | Light magenta ink | Y | 1 | AA |
| Example 23 | 1 | 3 | Cyan ink | 5 | Light cyan ink | Y | 1 | AA |
| Example 24 | 1 | 3 | Cyan ink | 7 | Yellow ink | Y | 1 | AA |
| Example 25 | 1 | 5 | Magenta ink | 1 | Gray ink | Y | 1 | AA |
| Example 26 | 1 | 6 | Magenta ink | 1 | Gray ink | Y | 1 | AA |
| Example 27 | 1 | 5 | Magenta ink | 3 | Light magenta ink | Y | 1 | AA |
| Example 28 | 1 | 5 | Magenta ink | 5 | Light cyan ink | Y | 1 | AA |
| Example 29 | 1 | 5 | Magenta ink | 7 | Yellow ink | Y | 1 | AA |
| Example 30 | 1 | 1 | Black ink | 10 | Cyan ink | Y | 1 | AA |
| Example 31 | 1 | 1 | Black ink | 11 | Magenta ink | Y | 1 | AA |
| Example 32 | 1 | 3 | Cyan ink | 11 | Magenta ink | Y | 1 | AA |
| Example 33 | 1 | 1 | Black ink | 12 | Green ink | Y | 1 | AA |
| Example 34 | 1 | 1 | Black ink | 13 | Green ink | Y | 1 | AA |
| Example 35 | 1 | 1 | Black ink | 14 | Green ink | Y | 1 | AA |
| Example 36 | 1 | 1 | Black ink | 15 | Orange ink | Y | 1 | AA |
| Example 37 | 1 | 1 | Black ink | 16 | Orange ink | Y | 1 | AA |

TABLE 7

| Evaluation conditions and evaluation results | | | | | | | | |
|---|---|---|---|---|---|---|---|---|
| | Evaluation conditions | | | | | | | |
| | Kind of reaction liquid | First ink | | Second ink | | Relationship of brightness between first and second inks | Kind of liquid absorption member | Suppression of image contamination |
| | | No. | Kind | No. | Kind | | | |
| Example 38 | 1 | 1 | Black ink | 17 | Blue ink | Y | 1 | AA |
| Example 39 | 1 | 1 | Black ink | 18 | Blue ink | Y | 1 | AA |
| Example 40 | 1 | 7 | Blue ink | 15 | Orange ink | Y | 1 | AA |
| Example 41 | 1 | 8 | Gray ink | 3 | Light magenta ink | Y | 1 | AA |
| Example 42 | 1 | 8 | Gray ink | 5 | Light cyan ink | Y | 1 | AA |
| Example 43 | 1 | 8 | Gray ink | 7 | Yellow ink | Y | 1 | AA |
| Example 44 | 1 | 1 | Black ink | 19 | Gray ink | Y | 1 | AA |
| Example 45 | 1 | 1 | Black ink | 20 | Gray ink | Y | 1 | B |
| Example 46 | 1 | 1 | Black ink | 21 | Gray ink | Y | 1 | A |
| Example 47 | 1 | 1 | Black ink | 22 | Gray ink | Y | 1 | AA |
| Example 48 | 1 | 1 | Black ink | 23 | Gray ink | Y | 1 | A |
| Example 49 | 1 | 1 | Black ink | 24 | Gray ink | Y | 1 | A |
| Example 50 | 1 | 1 | Black ink | 1 | Gray ink | Y | 3 | A |
| Example 51 | 1 | 1 | Black ink | 1 | Gray ink | Y | 2 | AA |
| Example 52 | 1 | 1 | Black ink | 1 | Gray ink | Y | 1 | AA |
| Example 53 | 1 | 9 | Black ink | 25 | Gray ink | Y | 1 | AA |
| Example 54 | 1 | 9 | Black ink | 26 | Gray ink | Y | 1 | AA |
| Example 55 | 1 | 1 | Black ink | 25 | Gray ink | Y | 1 | AA |
| Example 56 | 1 | 1 | Black ink | 27 | Gray ink | Y | 1 | A |
| Example 57 | 1 | 10 | Black ink | 28 | Gray ink | Y | 1 | AA |
| Example 58 | 1 | 10 | Black ink | 29 | Gray ink | Y | 1 | AA |
| Comp. Ex. 1 | — | 1 | Black ink | 1 | Gray ink | Y | 1 | C |
| Comp. Ex. 2 | 1 | 1 | Black ink | — | — | — | 1 | C |
| Ref. Ex. 1 | 1 | 1 | Black ink | 1 | Gray ink | Y | 1 | AA |
| Ref. Ex. 2 | 1 | 8 | Gray ink | 30 | Black ink | N | 1 | AA |
| Ref. Ex. 3 | 1 | 8 | Gray ink | 30 | Black ink | N | 1 | C |
| Ref. Ex. 4 | 1 | 11 | Light magenta ink | 30 | Black ink | N | 1 | C |
| Ref. Ex. 5 | 1 | 12 | Light cyan ink | 30 | Black ink | N | 1 | C |
| Ref. Ex. 6 | 1 | 13 | Yellow ink | 30 | Black ink | N | 1 | C |
| Ref. Ex. 7 | 1 | 8 | Gray ink | 31 | Cyan ink | N | 1 | C |
| Ref. Ex. 8 | 1 | 11 | Light magenta ink | 31 | Cyan ink | N | 1 | C |
| Ref. Ex. 9 | 1 | 12 | Light cyan ink | 31 | Cyan ink | N | 1 | C |
| Ref. Ex. 10 | 1 | 13 | Yellow ink | 31 | Cyan ink | N | 1 | C |
| Ref. Ex. 11 | 1 | 8 | Gray ink | 32 | Magenta ink | N | 1 | C |
| Ref. Ex. 12 | 1 | 11 | Light magenta ink | 32 | Magenta ink | N | 1 | C |
| Ref. Ex. 13 | 1 | 12 | Light cyan ink | 32 | Magenta ink | N | 1 | C |
| Ref. Ex. 14 | 1 | 13 | Yellow ink | 32 | Magenta ink | N | 1 | C |

In Referential Examples 1 and 2, curling or cockling occurred so that the results were on an unacceptable level.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131064, filed Jul. 4, 2017, and Japanese Patent Application No. 2018-111477, filed Jun. 11, 2018, which are hereby incorporated by reference herein in their entirety.

What is claimed is:

1. An ink jet recording method for recording an image on a recording medium using an aqueous reaction liquid comprising a reactant, a first ink, and a second ink, with each of the first ink and the second ink being a water-based ink comprising a coloring material, the method comprising:

a reaction liquid applying step of applying the reaction liquid to a first recording medium;

an image formation step of forming a first image by applying the first ink and the second ink in order of mention to the first recording medium, so as to overlap at least partially with a region to which the reaction liquid has been applied; and a liquid absorption step of bringing a porous layer possessed by a liquid absorption member into contact with the first image to absorb a liquid component therefrom, wherein the second ink has a brightness higher than a brightness of the first ink.

2. The ink jet recording method according to claim 1, wherein the first ink is a black ink.

3. The ink jet recording method according to claim 1, wherein the first ink and the second ink have the same hue.

4. The ink jet recording method according to claim 1, wherein the second ink comprises resin particles.

5. The ink jet recording method according to claim 4, wherein, in the second ink, a ratio of the content (mass %) of the coloring material to the content (mass %) of the resin particles is 0.03 times or more to 0.20 times or less.

6. The ink jet recording method according to claim 1, wherein the second ink comprises a water-soluble resin having an anionic group.

7. The ink jet recording method according to claim 1, wherein the porous layer comprises a fluorine-based resin.

8. The ink jet recording method according to claim 1, wherein the first recording medium is a transfer body, and the ink jet recording method further comprises, after the liquid absorption step, a transfer step of transferring the first image of the first recording medium to the recording medium.

9. The ink jet recording method according to claim 1, wherein the reactant comprises an organic acid.

10. The ink jet recording method according to claim 9, wherein the content (mass %) of the organic acid in the reaction liquid is 1.0 mass % or more to 50.0 mass % or less based on the total mass of the reaction liquid.

11. The ink jet recording method according to claim 9, wherein the content (mass %) of the organic acid in the reaction liquid is 15.0 mass % or more to 45.0 mass % or less based on the total mass of the reaction liquid.

12. The ink jet recording method according to claim 1, wherein the reaction liquid further comprises a fluorine-based surfactant.

13. The ink jet recording method according to claim 12, wherein the content (mass %) of the fluorine-based surfactant is 2.0 mass % or more to 10.0 mass % or less based on the total mass of the reaction liquid.

14. The ink jet recording method according to claim 1, wherein the second ink comprises resin particles and a water-soluble resin having an anionic group, and wherein a mass ratio of the content (mass %) of the water-soluble resin having an anionic group to the content (mass %) of the resin particles is 0.05 times or more to 0.50 times or less.

15. The ink jet recording method according to claim 1, wherein the reaction liquid is applied to the first recording medium with a roller.

16. An ink jet recording apparatus comprising (i) a unit for applying a reaction liquid to a first recording medium and then applying a first ink and a second ink in order of mention and (ii) a unit for bringing a porous layer possessed by a liquid absorption member into contact with a first image formed with the first ink and the second ink, wherein the reaction liquid is an aqueous reaction liquid comprising a reactant, wherein the first ink and the second ink are each a water-based ink comprising a coloring material, and wherein the second ink has a brightness higher than a brightness of the first ink.

* * * * *